US011187496B2

(12) United States Patent
Sullivan

(10) Patent No.: US 11,187,496 B2
(45) Date of Patent: Nov. 30, 2021

(54) METHOD AND APPARATUS FOR IMPROVING THE AIM OF A WEAPON STATION, FIRING A POINT-DETONATING OR AN AIR-BURST PROJECTILE

(71) Applicant: NOSTROMO HOLDINGS, LLC, Alexandria, VA (US)

(72) Inventor: Kevin Michael Sullivan, Kennebunk, ME (US)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 0 days.

(21) Appl. No.: 16/682,202

(22) Filed: Nov. 13, 2019

(65) Prior Publication Data

US 2020/0141697 A1 May 7, 2020

Related U.S. Application Data

(60) Division of application No. 15/860,792, filed on Jan. 3, 2018, now Pat. No. 10,514,234, which is a continuation-in-part of application No. 15/200,023, filed on Jul. 1, 2016, now Pat. No. 9,879,963, which is a continuation-in-part of application No. (Continued)

(51) Int. Cl.

| | |
|---|---|
| ***G06G 7/80*** | (2006.01) |
| ***F41G 3/14*** | (2006.01) |
| ***F41G 3/06*** | (2006.01) |
| ***F41G 3/02*** | (2006.01) |
| ***F42C 13/08*** | (2006.01) |
| ***F42C 13/02*** | (2006.01) |
| ***F42C 13/04*** | (2006.01) |
| ***F41G 3/22*** | (2006.01) |
| ***F41G 3/12*** | (2006.01) |
| *F42B 12/20* | (2006.01) |

(52) U.S. Cl.

CPC ..... *F41G 3/142* (2013.01); *F41G 3/02* (2013.01); *F41G 3/06* (2013.01); *F41G 3/12* (2013.01); *F41G 3/22* (2013.01); *F42C 13/026* (2013.01); *F42C 13/047* (2013.01); *F42C 13/08* (2013.01); *F42B 12/20* (2013.01); *F42B 12/202* (2013.01)

(58) Field of Classification Search

CPC ... F21G 3/142; F21G 3/02; F21G 3/06; F21G 3/12; F21G 3/22; F42C 13/026; F42C 13/047; F42C 13/08; F42B 12/20; F42B 12/22; F42B 12/202; F41G 3/02; F41G 3/06; F41G 3/12; F41G 3/142; F41G 3/22

USPC ..... 235/404, 400, 407, 408, 411, 412

See application file for complete search history.

(56) References Cited

U.S. PATENT DOCUMENTS

| | | | |
|---|---|---|---|
| 4,862,785 | A | 9/1989 | Ettel et al. |
| 5,026,158 | A | 6/1991 | Golubic |

(Continued)

*Primary Examiner* — Thien M Le

(74) *Attorney, Agent, or Firm* — Robert W. Morris; Eckert Seamans Cherin & Mellott, LLC

(57) ABSTRACT

The method and apparatus for a remote weapon station or incorporated into manually-aimed weapons. The methodology requires use of a muzzle velocity sensor that refines the aiming of the second and subsequent fires or volleys fired from weapon systems. When firing the first volley a weapon uses an estimated velocity and, at firing, the muzzle velocity of a projectile is measured. When firing the second volley a weapon's fire control calculates an aiming point using the measured velocity of the first volley.

35 Claims, 24 Drawing Sheets

Related U.S. Application Data

14/829,839, filed on Aug. 19, 2015, now Pat. No. 9,600,900, which is a continuation-in-part of application No. 14/227,054, filed on Mar. 27, 2014, now abandoned.

(60) Provisional application No. 61/805,534, filed on Mar. 27, 2013.

(56) References Cited

U.S. PATENT DOCUMENTS

| | | | | |
|---|---|---|---|---|
| 5,814,756 | A | 9/1998 | Boss | |
| 5,834,675 | A | 11/1998 | Boss | |
| 6,138,547 | A | 10/2000 | Larsson et al. | |
| 6,170,377 | B1 | 1/2001 | Larsson et al. | |
| 6,216,595 | B1 | 4/2001 | Lamorlette et al. | |
| 8,074,555 | B1 | 12/2011 | Sullivan et al. | |
| 8,286,872 | B2 | 10/2012 | Laupstad et al. | |
| 8,499,693 | B2 | 8/2013 | Sullivan et al. | |
| 9,600,900 | B2 | 3/2017 | Sullivan | |
| 2005/0126379 | A1 | 6/2005 | Pikus et al. | |
| 2012/0105832 | A1* | 5/2012 | Streuber | F42B 10/62 356/138 |
| 2012/0143551 | A1* | 6/2012 | Burkland | F41G 7/002 702/104 |
| 2015/0247714 | A1* | 9/2015 | Teetzel | G05D 1/107 244/3.11 |

* cited by examiner

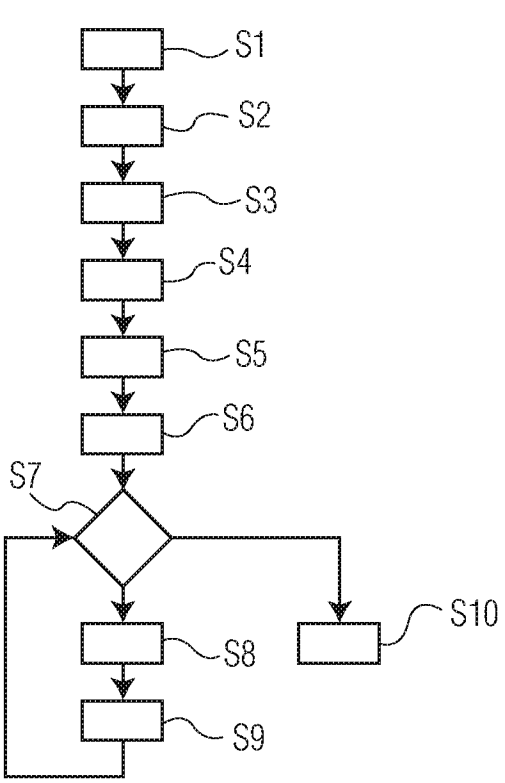
FIG. 1A
PRIOR ART
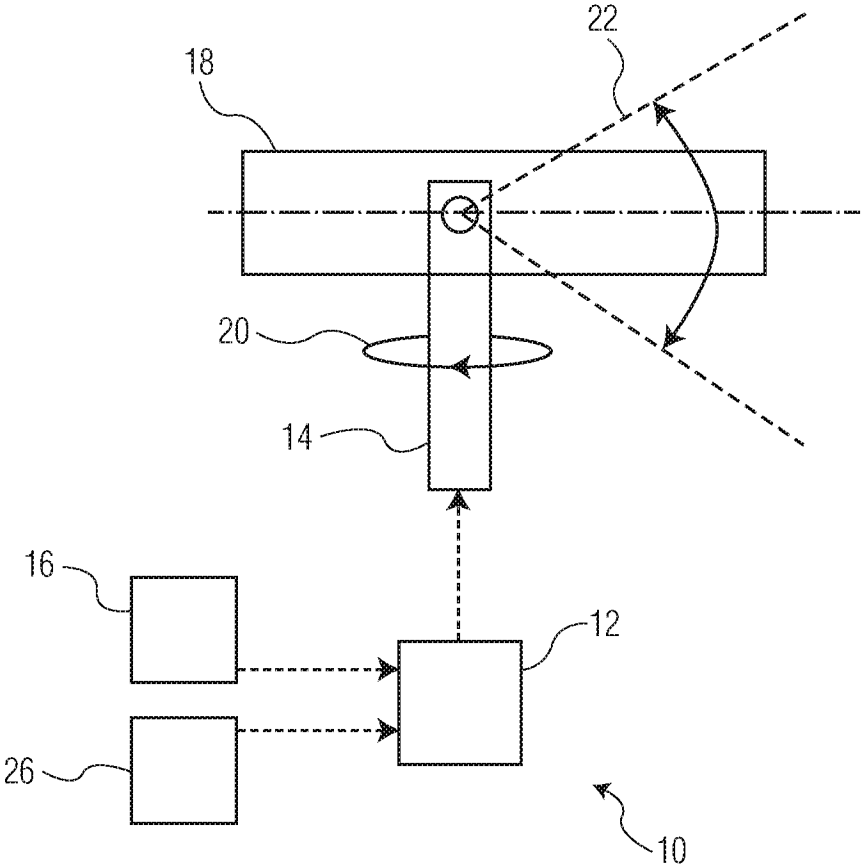

MODELING 40mm x 53 UNCORRECTED VOLLEYS

| MEAN LOT MUZZLE VELOCITY | AVERAGE MISS DISTANCE (IMPACT POINT) | ADJUSTED MISS DISTANCE (5 METER LETHAL RADIUS) |
|---|---|---|
| 237 METERS / SECOND | 24 METERS | 19 METERS |
| 238 METERS / SECOND | 18 METERS | 14 METERS |
| 239 METERS / SECOND | 10 METERS | 6 METERS |

FIG. 1H

METHOD AND APPARATUS FOR IMPROVING THE AIM OF A WEAPON STATION, FIRING A POINT-DETONATING OR AN AIR-BURST PROJECTILE

CROSS-REFERENCE TO RELATED APPLICATIONS

This application is a continuation application of U.S. patent application Ser. No. 15/860,792, filed Jan. 3, 2018, which is a continuation-in-part of U.S. patent application Ser. No. 15/200,023, filed Jul. 1, 2016 (published as US 2017/0097216), which application, in turn, is a continuation-in-part of U.S. patent application Ser. No. 14/829,839, filed Aug. 19, 2015 (published as US 2016/0055652 and now U.S. Pat. No. 9,600,900), which application, in turn, is a continuation-in-part of U.S. application Ser. No. 14/227,054, filed Mar. 27, 2014 (published as US 2016/0252335) which, in turn, claims priority from the U.S. Provisional Application No. 61/805,534 filed Mar. 27, 2013. The present application claims priority from all of the aforementioned patent applications and from the Provisional Application No. 61/805,534 filed Mar. 27, 2013.

To the extent permitted by law, the disclosures of the aforementioned patent and patent applications are incorporated herein by reference. The disclosure of U.S. Pat. No. 8,286,872 is also incorporated herein by reference.

BACKGROUND OF THE INVENTION

The present invention relates to military fire control systems generally and, more specifically, to a system for adjusting the elevation and traverse of the gun barrel in a weapon station in dependence upon certain parameters, such as the measured muzzle velocity of a previously fired munition.

Remote Weapon Station: By way of background, it is useful to consider the presently existing methods and systems of firing programmable ammunition from a so-called "remote weapon station" ("RWS"). When firing conventional ammunition an RWS Operator (1) ranges the target to ascertain the target range, and (2) elevates the barrel of the weapon to align reticules (whereupon the fire control computer identifies the elevation and deflection offsets using range tables or standard ballistic computation in an algorithm). The RWS Operator then (3) fires the first volley and (4) manually adjusts for subsequent (2-6) volleys, making adjustments (for that same target) based on the actual observed impact of the ammunition. When firing air-burst ammunition, the current practice requires the RWS Operator to (1) laze the target to ascertain the range, (2) elevate the weapon to align reticules (whereupon the fire control computer identifies the elevation, deflection offsets and a calculated air-burst time, corresponding to a standard muzzle velocity using range tables or standard ballistic computation in an algorithm). The RWS Operator then (3) fires the first volley and the gunner (4) manually adjusts the aim (for that same target), firing subsequent (2-6) volleys while making adjustments based on the actual observed impact of the ammunition.

SUMMARY OF THE INVENTION

A principal objective of the present invention is to provide both a method or operating a weapon station and a manually-controlled weapon station configuration to improve the precision delivery of both conventional and programmable munition projectiles.

The present invention provides an efficient method and weapon configuration where the muzzle velocity of a first volley is measured and the elevation to fire the second volley is automatically adjusted. This adjustment is coupled with the measurement of muzzle velocity and a programming technology, as is fully disclosed in the U.S. Pat. No. 9,600,900.

According to the present invention, the remote weapon station ("RWS") system is modified to fire both conventional and air-burst cartridges as herein set forth. When firing conventional ammunition, the RWS Operator (1) lazes the target to ascertain the range, and (2) elevates the weapon to align reticules (the fire control computer identifies the elevation and deflection offsets using range tables or standard ballistic computation in an algorithm). The RWS Operator then (3) fires the first volley and the RWS system (4) automatically adjusts the elevation for second and subsequent volleys (at that same target) using the computed average muzzle velocity of the fired volleys. When firing programmable air-burst ammunition the RWS Operator (1) lazes the target to ascertain the range, and (2) elevates the weapon to align reticules (the fire control computer identifies the elevation, deflection offsets and a calculated air-burst time corresponding to a standard muzzle velocity using range tables or standard ballistic computation in an algorithm). The RWS Operator then (3) fires the first volley of ABM ammunition using the expected flight time and the RWS system (4) automatically adjusts both the elevation and air-burst time of flight for second and subsequent volleys (at that same target) using the computed average muzzle velocity of the fired volleys.

RWS systems fire belted ammunition that is packaged into ammunition cans and placed in remote weapon stations. The operator has the choice to select different cartridges, as each type of cartridge in a military's inventory has unique external ballistics. When a can of ammunition is expended, the spent can is removed and replaced with a new can of ammunition. Each ammunition can houses ammunition cartridges derived from a single production lot of ammunition. Realizing that the variation of ammunition velocity, within an ammunition lot, has a narrower variation that the variation of ammunition lot to lot, the method of using the pre-set default muzzle velocity data for a $1^{st}$ volley from an ammunition can, and adjusting the $2^{nd}$ volley based on the actual measured muzzle velocity of the $1^{st}$ volley, provides for a practical means to improve the aim and terminal effect of ammunition.

Ammunition Programming Technologies:

It is also useful to understand projectile programming technologies that may be coupled to remote weapon stations and manually controlled weapon systems. The first air-burst technologies fielded by the Oerlikon and Bofors companies appeared in the late 1980s. Oerlikon's U.S. patents include U.S. Pat. Nos. 4,862,785; 5,814,756, and 5,834,675 describing what has been marketed as the AHEAD system. The disadvantage of using the "Oerlikon AHEAD" technique is that it consumes a great deal of power with each shot because the programming coils used in this technique are bulky and heavy.

To overcome this disadvantage, Bofors introduced the Programmable Barrel Weapon technology as disclosed in U.S. Pat. No. 6,138,547 and this programming technology was incorporated into the US MK47 weapon system produced by GDOTS in Saco, Me. The published patent application US 2005/0126379 discloses RF data communication link for setting electronic fuzes. Whereas the programming of the projectile is only limited to pre-launch programming, the technique does not provide a method to program an in-flight projectile.

U.S. Pat. No. 6,216,595 discloses a process for the in-flight programming of the trigger time for a projectile element. The trigger time is transmitted via radio frequency signals which, unfortunately, admit to several disadvantages to effective transmission, such as interference from IED suppression technology. U.S. Pat. No. 6,170,377 to Bofors discloses a method and apparatus for transmission of programming data to the time fuze of a projectile via an inductive transmission coil. However, in the case of Oerlikon AHEAD, the inductive coils are very bulky and heavy. U.S. Pat. No. 6,138,547 discloses a method and system for programming fuzes using electric programming pulses to transmit data between a programmable fuze and a programming device. Due to oscillation of the projectile, it is difficult to maintain consistent contact or proximity between the external source of the programmed pulses and the conductor located on the projectile. Also, these various systems require extensive modification of the weapon design which limits their use. As the cost of power sources and the power consumption of electronics has dropped over time, a cost-effective approach to post-shot programming has become more practical.

For example, U.S. Pat. No. 8,499,693 describes a system for optically programming ammunition; this system has been incorporated into the German Army DM131 cartridge. Around the same time period, NAMMO introduced its radio programmed fuze.

The present invention provides a practical method and apparatus for improving the aim of both: (1) a remote weapon station or (2) configuration manually elevating a weapon, with hand held range finder, firing either conventional point-detonation ammunition cartridges or programmable air-burst munitions.

According to the invention, where a ballistic calculator in a fire control unit uses a pre-set default muzzle velocity ("MV") for a first shot or first volley fired from a given package or can of ammunition, the method comprises:

(a) determining and inputting to the ballistic calculator a range to the target;

(b) adjusting a barrel elevation by means of the ballistic calculator based on (1) the default MV for a projectile from the package or ammunition can and (2) the range to the target for a ballistic flight of the projectile toward the target;

(c) firing at least one projectile from the package or ammunition can toward the target;

(d) measuring an actual MV for the fired projectile(s) with a sensing device;

(e) adjusting the barrel elevation by means of the ballistic calculator based on the actual MV data measured by the sensing device and the range to the target: and (f) firing additional projectiles from the ammunition can toward a target.

Steps (e) through (f) are then repeated as often as desired.

The ammunition projectiles are retrieved, as needed, from an ammunition can stored on the remote weapon station. The projectiles in the can are conventionally linked together in a chain.

When a new can of ammunition is placed in use, the entire method is repeated, with the fire control's ballistic calculator setting a first fire control solution, a first elevation, using default muzzle velocity settings for each new can of ammunition.

According to a first preferred embodiment of the invention, the programmable air-burst projectiles have an optical sensor or modem that receives optical programming signals emitted from a transmitter electronically connected to, and physically adjacent to, the weapon station.

According to a second preferred embodiment of the invention, the programmable air-burst projectiles have an RF antenna that receives RF signals emitted from a transmitter electronically connected to, and physically adjacent to, the weapon station.

According to a third preferred embodiment of the invention, the programmable air-burst projectiles have a magnetic sensor that receives modulated electro-magnetic transmissions emitted from a magnetic modulating programmer electronically connected to, and physically adjacent to, the weapon station.

According to a fourth preferred embodiment of the invention, the programmable air-burst projectiles have an antenna that receives microwave band electro-magnetic transmissions emitted from a focused microwave programmer electronically connected to, and physically adjacent to, the weapon station.

The weapon station for carrying out the method according to the invention preferably comprises a weapon having a barrel with a muzzle and capable of firing ammunition projectiles from a common manufactured lot, preferably linked ammunition projectiles from an ammunition can; a mechanical support for the weapon configured for movement of the barrel in the elevation and azimuth directions; a sensing device disposed in or adjacent the weapon barrel for measuring the muzzle exit velocity (MV) of the fired projectiles; and a fire control unit, coupled to the MV sensing device and to the mechanical support, for controlling the movement of the weapon barrel.

The fire control unit includes a processor, responsive to a first input that receives a range of a desired target and a second input that receives an MV of an ammunition projectile, to calculate and produce an output to the mechanical support for setting the elevation of the weapon barrel prior to firing a projectile. The second input is configured to receive initially a default muzzle velocity for the ammunition projectiles, e.g., a linked chain of projectiles, from the ammunition can and, thereafter, post-shot of an initial firing such projectile(s), to receive an actual measured MV from said MV sensing device.

In a preferred embodiment of the invention, the fire control processor is operative to calculate a new setting for the weapon barrel elevation after the MV of an initial projectile volley is measured, thereby improving the aiming fidelity of the weapon.

Advantageously, the fire control processor is further operative to calculate a new setting of the weapon barrel elevation after the MV of each further projectile volley is measured, thereby to produce finer adjustments in the barrel elevation and thus continuously improve aiming precision for subsequent volleys.

Where a can of linked ammunition projectiles are programmable air-burst projectiles, the fire control processor is further operative to calculate a new setting of the weapon barrel elevation after the MV of each further projectile volley is measured, and to record a histogram of projectile MV's. The fire control processor uses the recorded histogram to continuously improve the elevation precision and the emitted projectile programming signal for the time of flight or burst of the projectile, to thereby improve the burst accuracy of second and subsequent projectile volleys.

In a preferred embodiment of the invention, the fire control processor adjusts the weapon barrel elevation for a terrestrial target to detonate the projectiles in the range of 1-3 meters above the desired target.

In a still further embodiment of the invention, a hand-held optical aiming device is used for determining the range to the desired target and for transmitting the range to the first input of said fire control unit.

For a full understanding of the present invention, reference should now be made to the following detailed description of the preferred embodiments of the invention as illustrated in the accompanying drawings.

BRIEF DESCRIPTION OF THE DRAWINGS

FIG. 1A depicts a system diagram and function sequence for a prior Art Kongsberg Remote Weapon Station (RWS).

FIG. 1H shows modeling results for 40 mm×53 uncorrected volleys.

DETAILED DESCRIPTION OF THE PREFERRED EMBODIMENTS

Figure 1B:
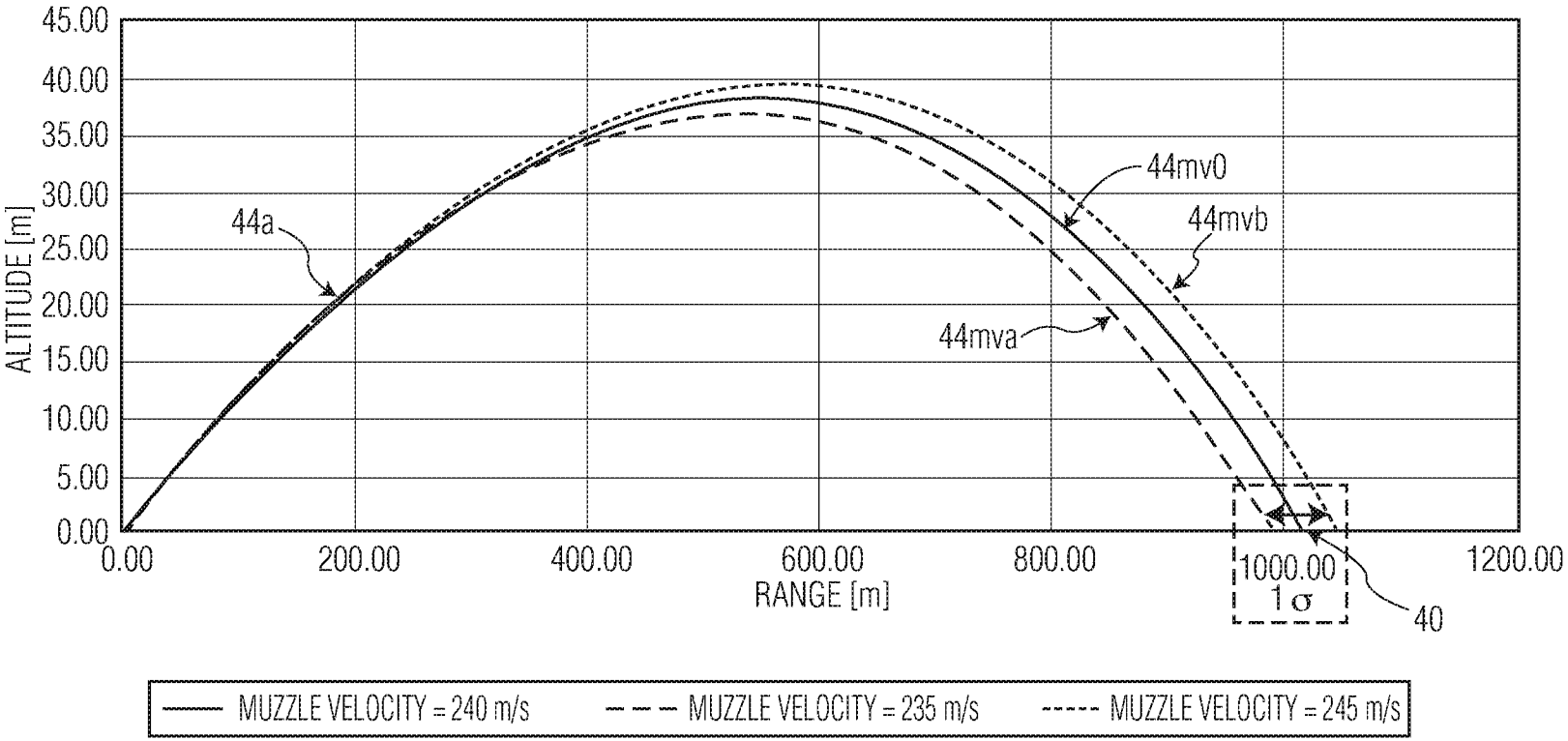
FIG. 1B depicts 40 mm terrestrial target ballistics at 1000 meters for the RWS shown in FIG. 1A.

The relevant prior art as well as the preferred embodiments of the present invention will now be described with reference to FIGS. 1A-4F of the drawings. Identical elements are designated with the same reference numerals.

Prior Art:

For context and for an understanding of the present state of the art, it is useful to examine the existing remote weapon station configurations to illuminate how lot-to-lot variation of mean muzzle velocity in 40 mm cartridges influences calculated aiming solutions. FIGS. 1A-1F depict benchmarks and performance characteristics delivered in existing systems.

FIG. 1A includes diagrams similar to those in the U.S. Pat. No. 8,286,872 for a remote weapon station optimized to fire air-burst ammunition. FIG. 1B depicts a 40 mm AGL ballistic flight path when aimed to impact near a ground target at 1000 meters.

Figure 1C:
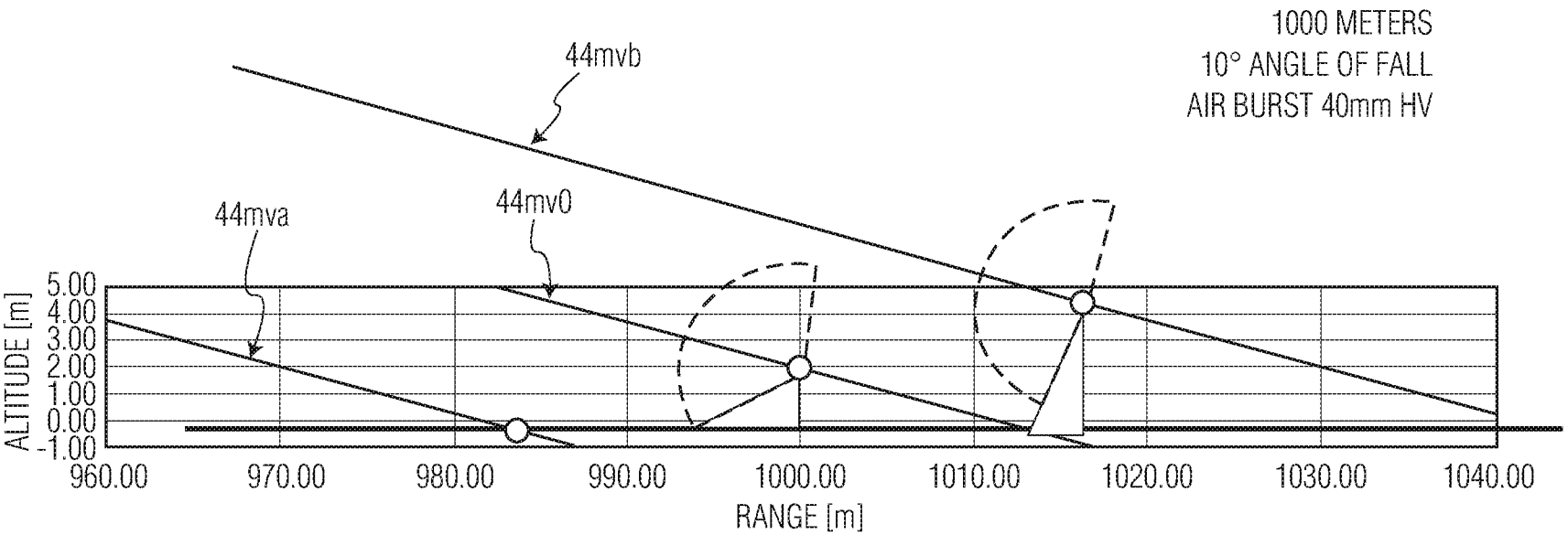
FIG. 1C depicts a detail of the 40 mm terrestrial target ballistics at 1000 meters shown in FIG. 1B.

Most fire control algorithms, presently in use, use encoded reference elevation tables and algorithms with an assumed standard muzzle velocity to calculate elevation. Unfortunately, the lot-to-lot variations of 40 mm×53 ammunition often result in the remote weapon station's missing their targets at extended ranges. FIG. 1B shows both the ballistic flight 44*mva* of a cartridge fired with a 1 sigma muzzle velocity (lower muzzle velocity compared to the firing table algorithm) and the ballistic flight path 44*mvb* of a cartridge fired with a 1 sigma muzzle velocity (above the firing tables average muzzle velocity). FIG. 1C is an enlarged view of the terminal ballistics resulting from the varying muzzle velocities 44*mv*0, 44*mva* and 44*mvb*, depicting the detonation of a programmable 40 mm×53 air-burst ammunition projectile when fired along the ballistic flight path.

Figure 1D:
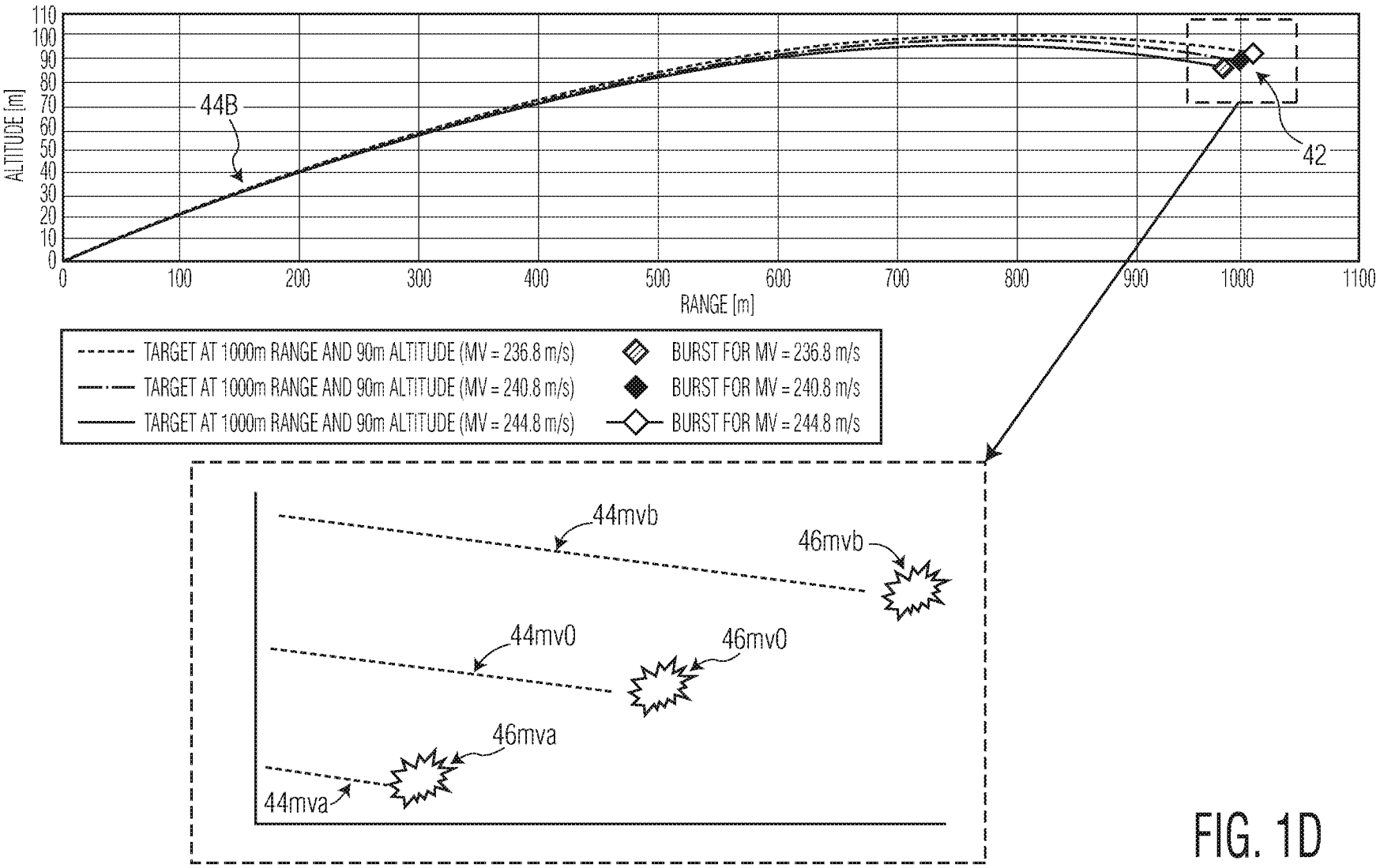
FIG. 1D depicts 40 mm drone (UAS) target ballistics at 1000 meters for the RWS shown in FIG. 1A.
Figure 1E:
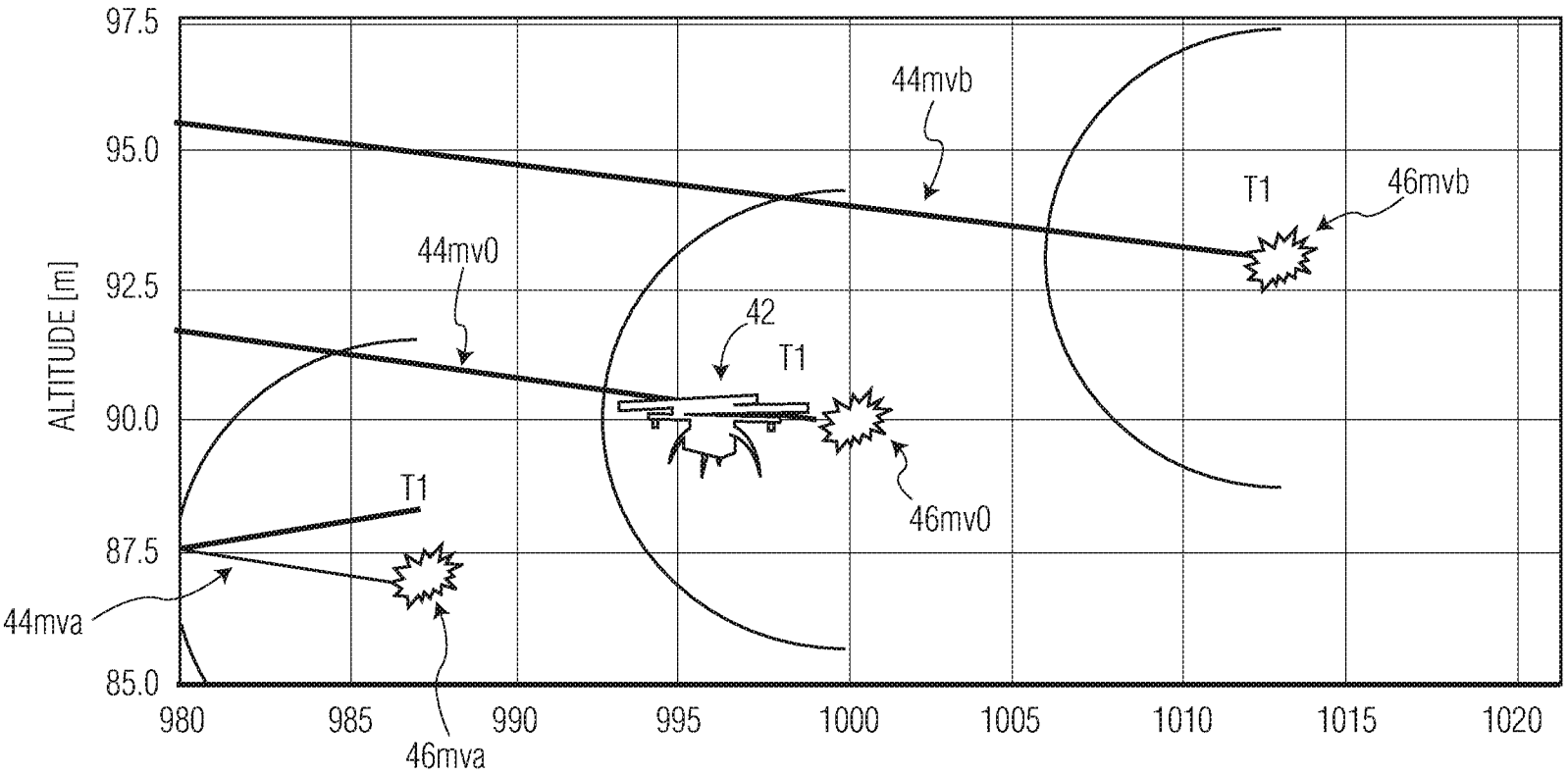
FIG. 1E depicts a detail of the 40 mm UAS target ballistics at 1000 meters shown in FIG. 1D.
Figure 1F:
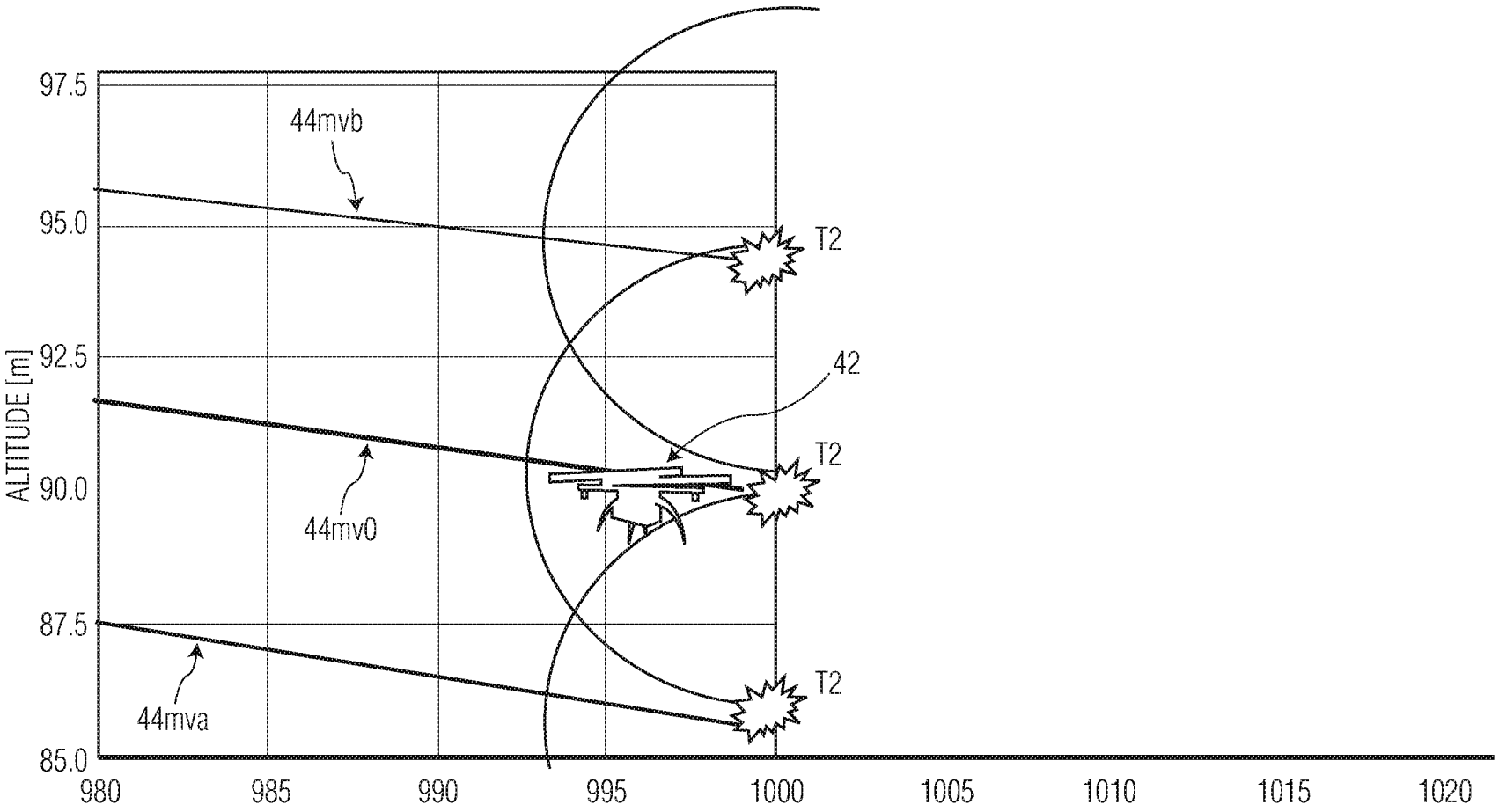
FIG. 1F PRIOR ART
FIG. 1F depicts prior Art 40 mm terminal ballistics using the methodology described in the U.S. Pat. No. 9,600,900.

FIG. 1D depicts the ballistic path 44 of a 40 mm AGL projectile firing at a target at an elevation of 90 meters and, for a set time, the detonation locations 46*mva*, 46*mv*0 and 46*mvb* along the flight paths 44*mva*, 44*mv*0 and 44*mvb*, respectively, for ammunition without adjusted programmed time to detonation and without and second volley elevation adjustment. FIG. 1E illustrates the burst point variation transposed over a target UAV 42. FIG. 1F depicts the utility of adjusting the programmed flight time (to detonation) T2 in accordance with the method disclosed in the U.S. Pat. No. 9,600,900, and an automated elevation adjustment according to the present invention.

Figure 1G:
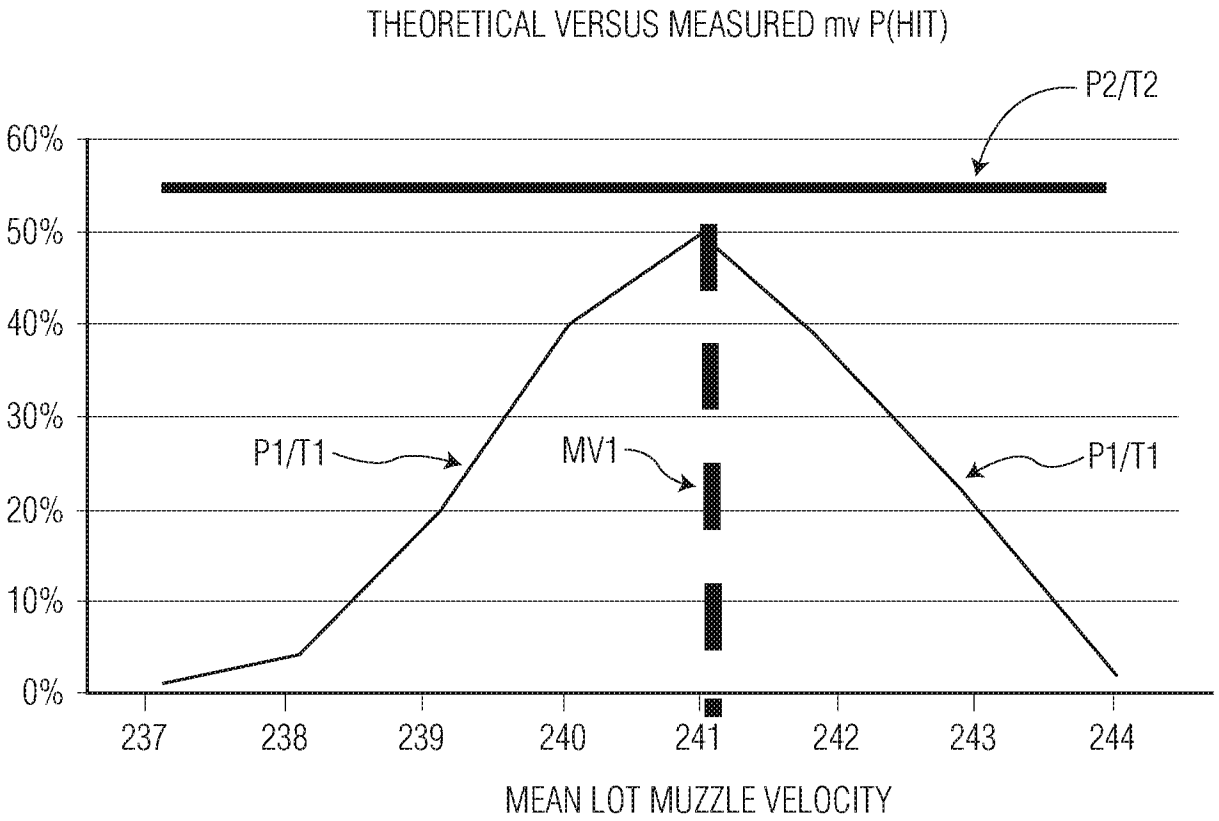
FIG. 1G is a graph of theoretical versus measured muzzle velocity and P(hit).

FIG. 1G is a simple graph, produced from modeling, identifying the mean miss distance of 40 mm high velocity ammunition for known projectile mean lot variation. FIG. 1H is a table showing the calculated probability of the average and adjusted miss distance for a first volley, as the muzzle velocity of a lot varies from the mean.

The purpose of the present invention is to improve a gunner's aiming for second and subsequent volleys. I may be incorporated into both remote weapon stations and manually-controlled weapon and fire control combinations.

Figure 2A:
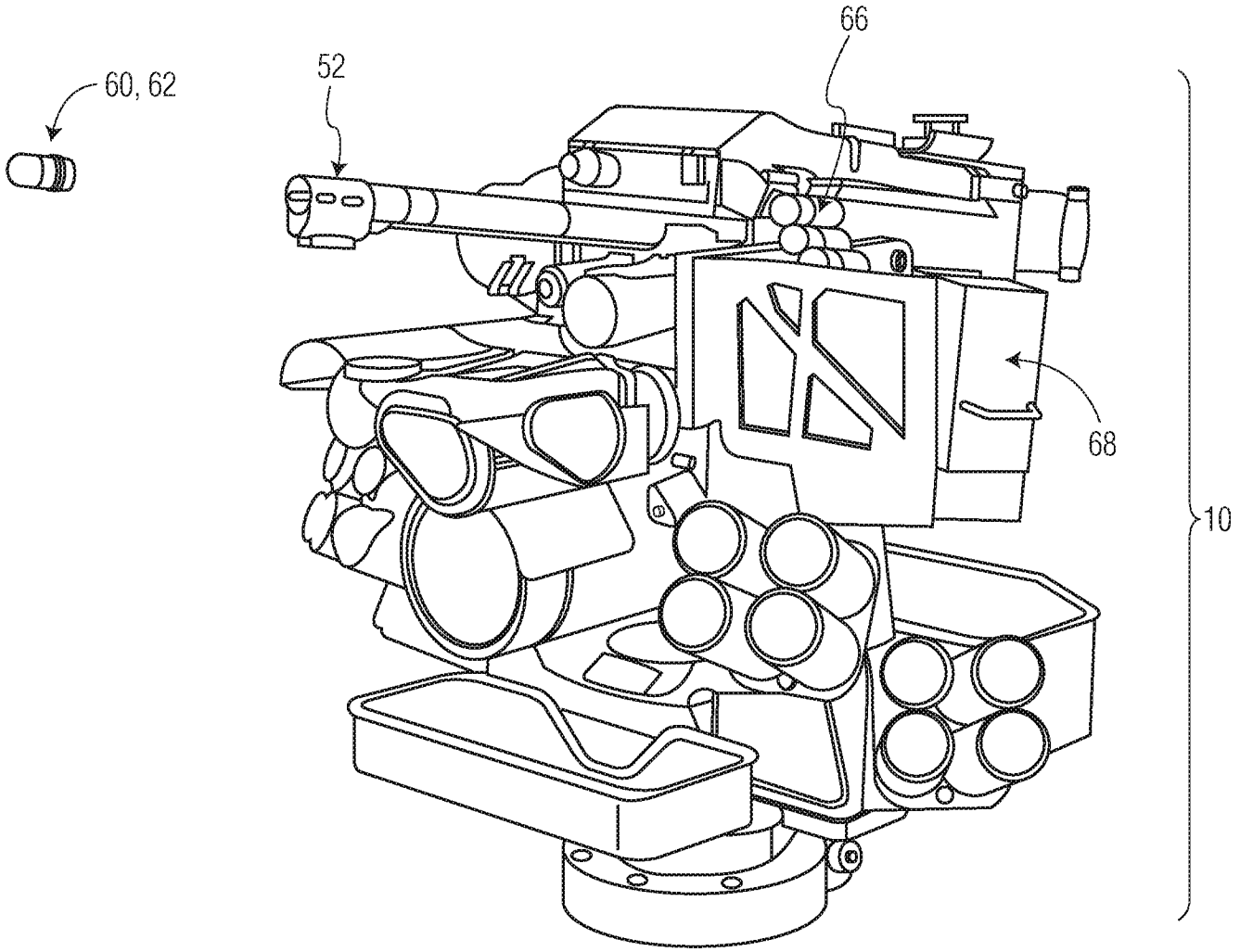
FIG. 2A shows a US M151 Remote Weapon Station ("RWS") with a muzzle velocity ("MV") measurement device on a MK19 firing an ammunition projectile.
Figure 2B:
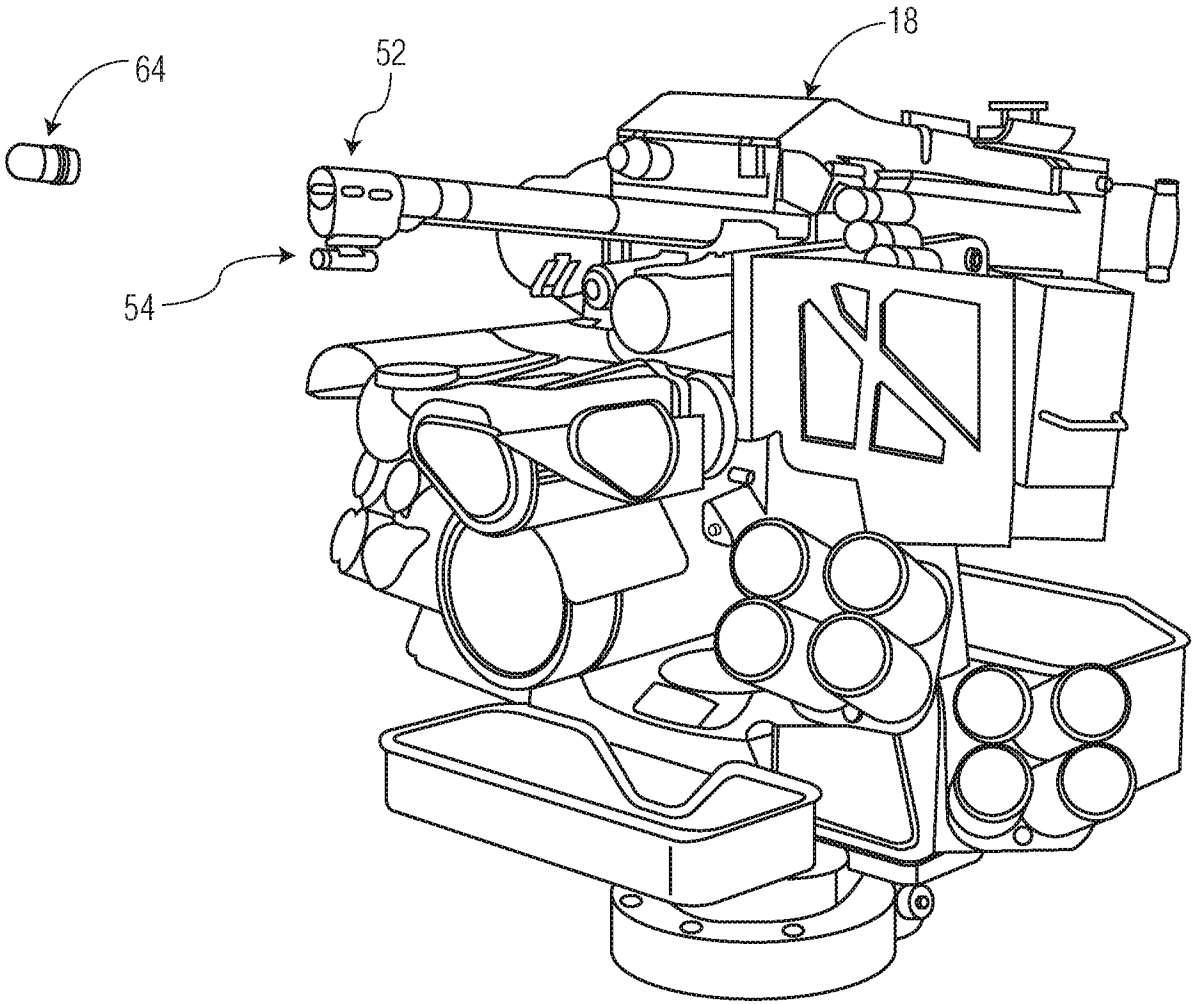
FIG. 2B shows a US M151 RWS with an MV measurement device on a MK19 firing an optically programmed projectile.

FIGS. 2A, 2B, 2C and 2D, with reference to corresponding FIGS. 3A, 3B, 3C and 3D, respectively, depict several embodiments 10 of the subject invention incorporated into a remote weapon station, with a muzzle velocity measurement device 52, that fires a projectile 60. The unfired projectiles are fitted in cartridges 66, that are stored in an ammunition can 68, in the rack of a Remote Weapon Station (FIG. 2A). These embodiments include a fire control computer 12, having a memory storage 12B and running a fire control algorithm 12D, mounted into a mechanical support 18 on a weapon. The muzzle velocity measurement device 52 feeds data to the memory storage 12B and the fire control algorithm 12D calculates the ballistic flight path. The system preferably incorporates a programmer 54 capable of programming ammunition projectiles 64 when they are fired from the weapon.

Figure 2C:
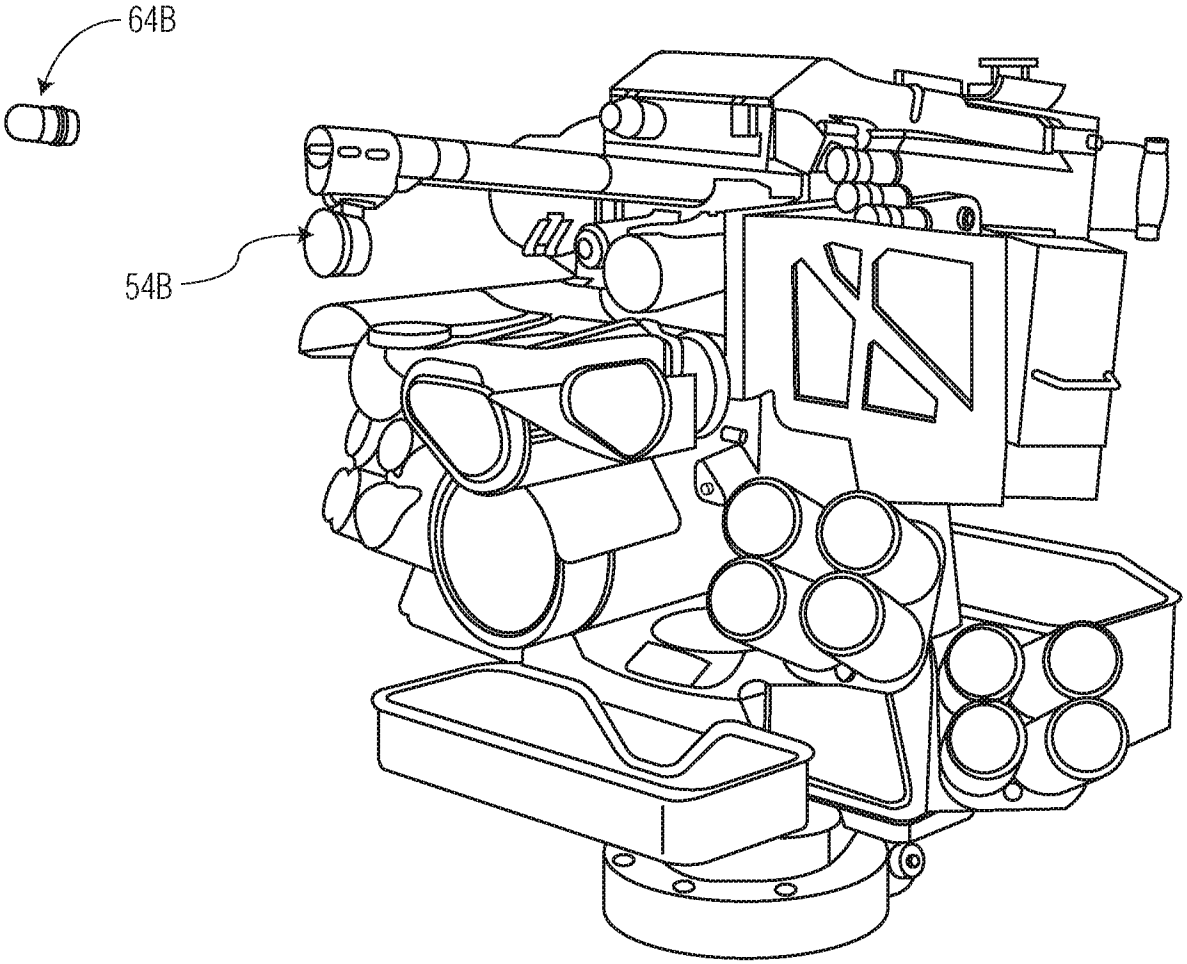
FIG. 2C shows a US M151 RWS with an MV measurement device on a MK19 firing an RF or extended range magnetically programmed projectile.

FIG. 2C depicts an RF programmer 54B on the muzzle of the weapon that programs an RF programmable projectile 64B. After a first volley V1, the system automatically re-aims, the mounted weapon producing an improved aiming elevation.

The embodiments of the invention shown in FIGS. 2A, 2B, 2C and 2D operate to fire a projectile 60, which may be conventional 62 or programmable 64. These embodiments include a muzzle velocity measurement device 52 that measures each projectile's muzzle velocity MV, stores this muzzle velocity in the memory 12B, and then employs the ballistic algorithm 12D to recalculate and reset the elevation 22B after firing. The second and subsequent volleys thus have an improved aim elevation, compared to the first volley.

Figure 2D:
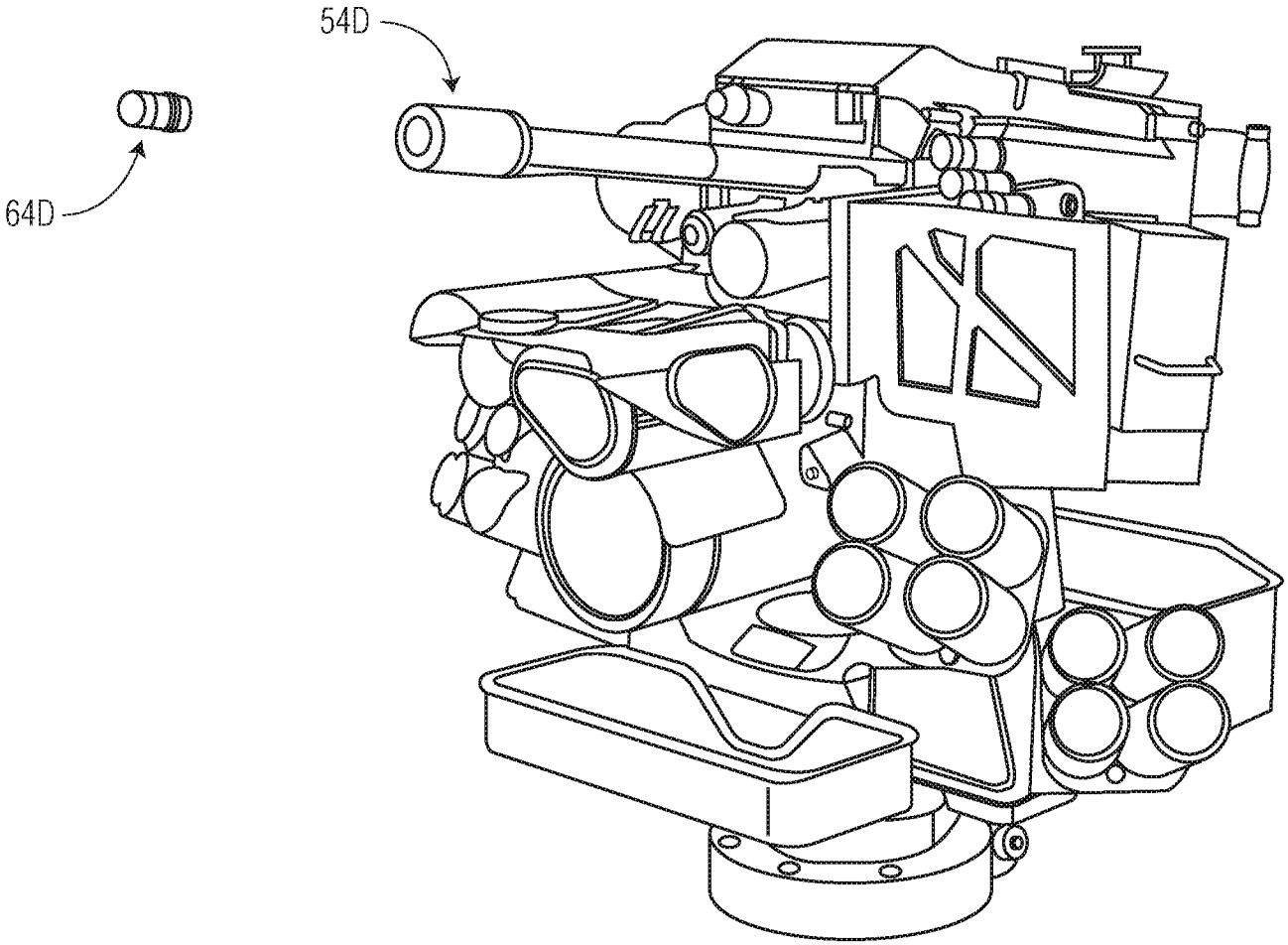
FIG. 2D shows a US M151 RWS with an MV measurement device.

FIG. 2D depicts an in-bore programmed projectile 64D, with an in-bore muzzle velocity measurement and programmer 54D as provided for in the Oerlikon (AHEAD) patents referred to above, which are licensed to STK (Singapore) and to General Dynamics Ordnance and Tactical Systems (US).

Figure 2E:
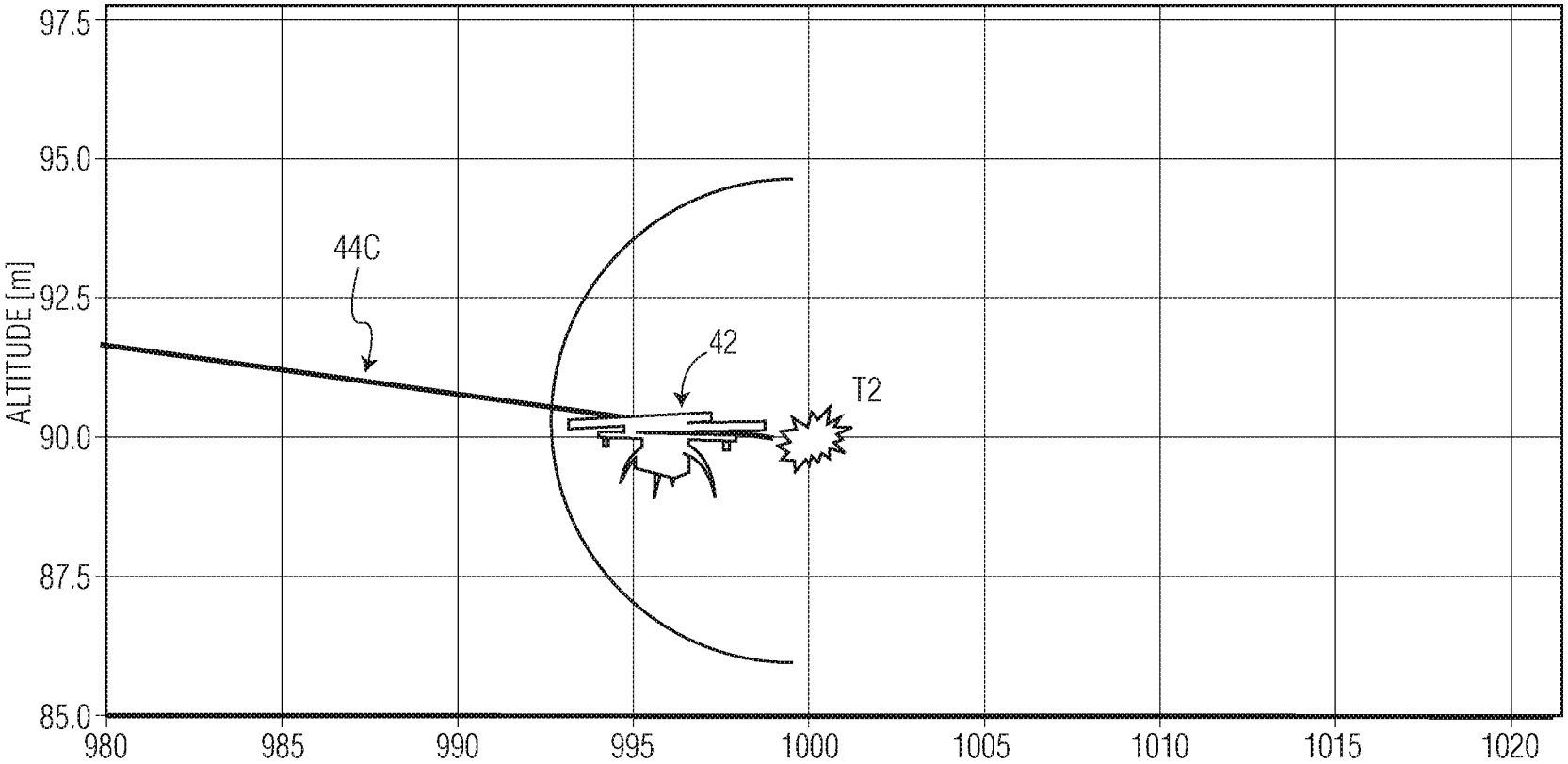
FIG. 2E depicts 40 mm UAS target ballistics at 1000 meters for the US M151 RWS with an MV measurement device shown in FIG. 2D.
Figure 2F:
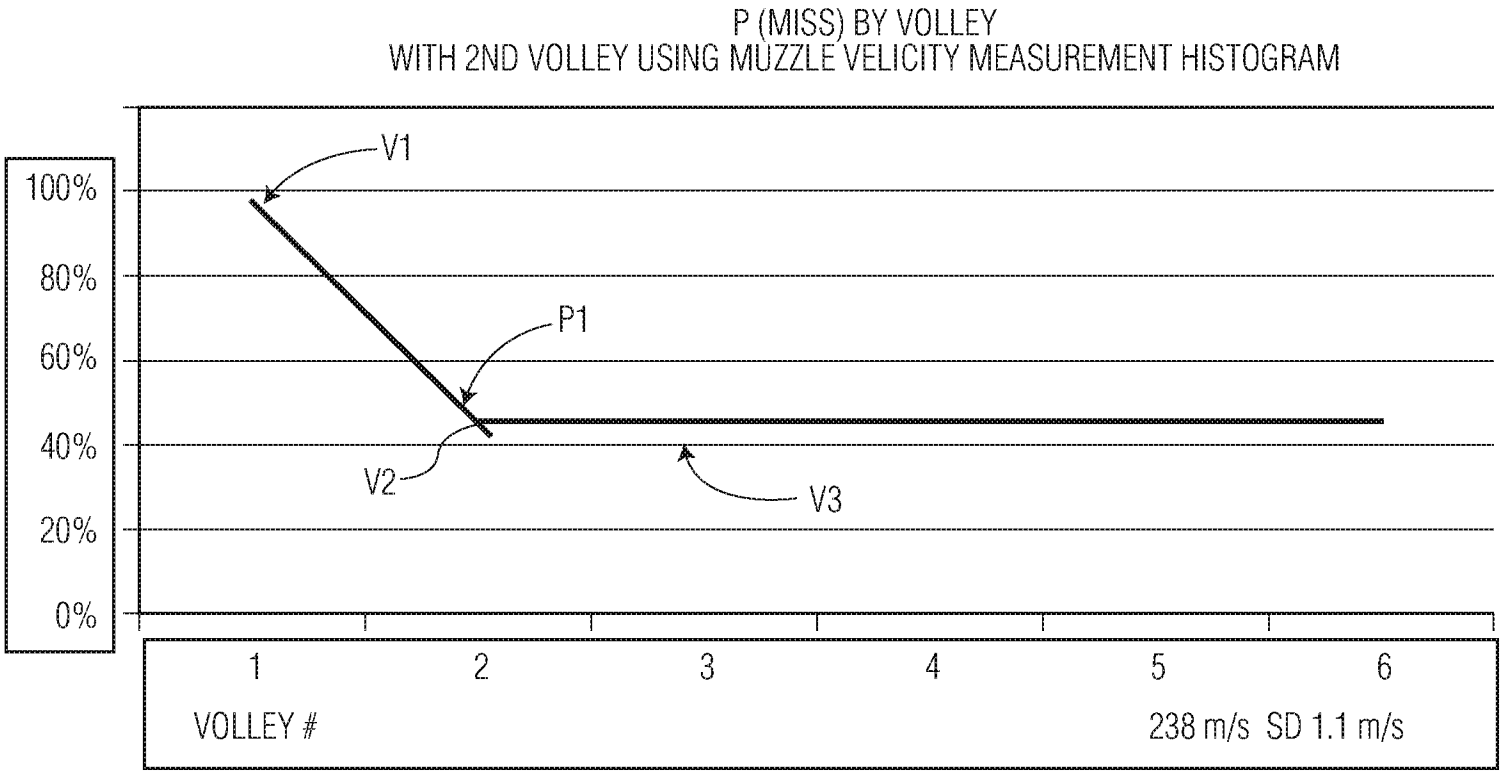
FIG. 2F depicts the average miss distance resulting from a 40 mm (lot) muzzle velocity variation from a ballistic solution's theoretical solution.

FIGS. 2E and 2F depict the expected improvement in firing with an unmanned system located at a range of 1000 meters and at an altitude of 90 meters. FIG. 2E depicts the projectile's improved ballistic path 44C, and the projectile's detonation at an adjusted time T2 in close proximity to the target 42. FIG. 2F depicts the forecasted improvement of a remote weapon station with the remote adjustment of the second volley, where the first volley V1 has a low probability of hit and the second volley V2 has an improved probability of hit P1. The initial aim point 12E for the initial firing test uses the assumed muzzle velocity for the lot of ammunition.

Figure 3A:
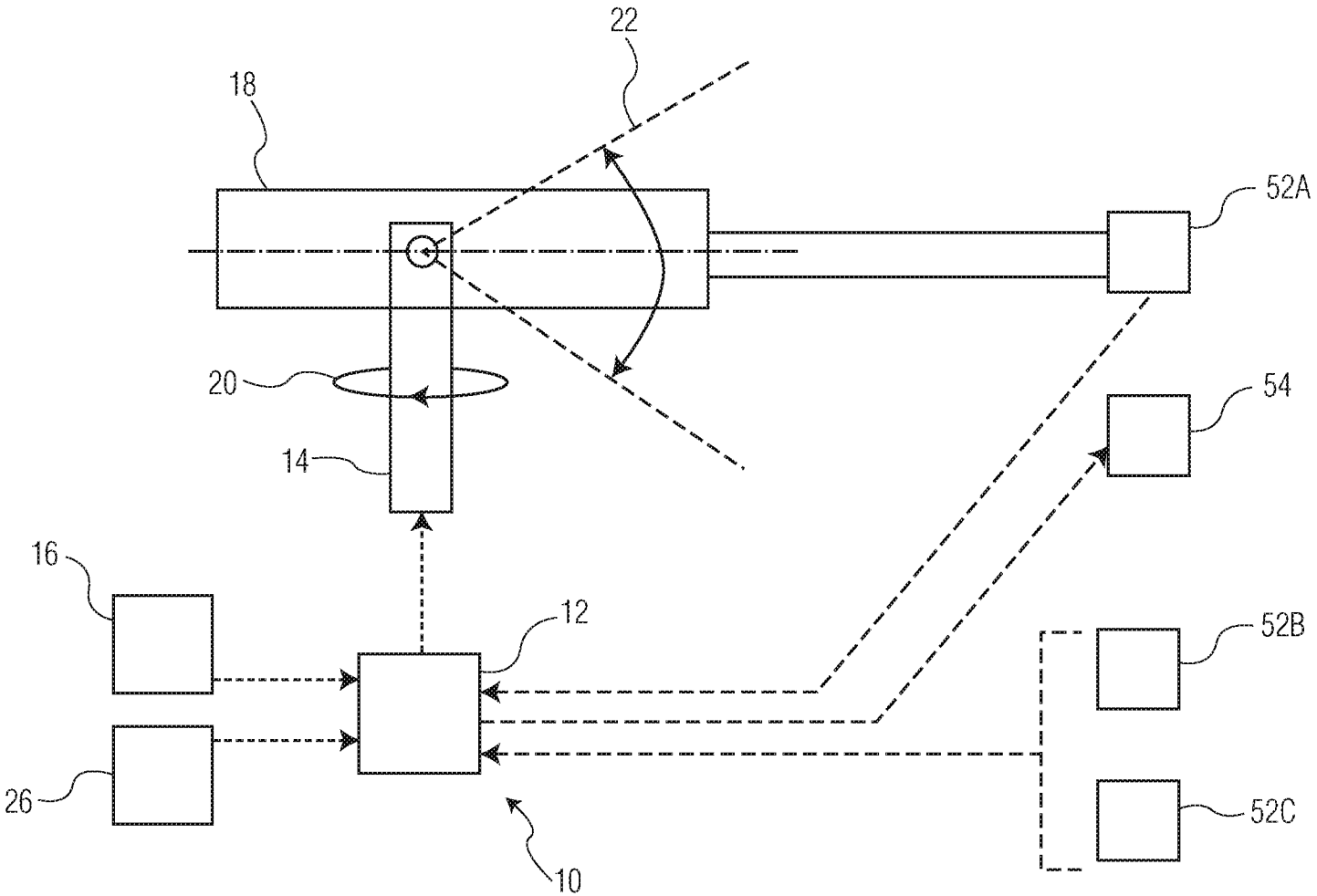
FIG. 3A is a system block diagram for a US M151 RWS, improved with the addition of a muzzle velocity measurement and an air-burst programmer.
Figure 3B:
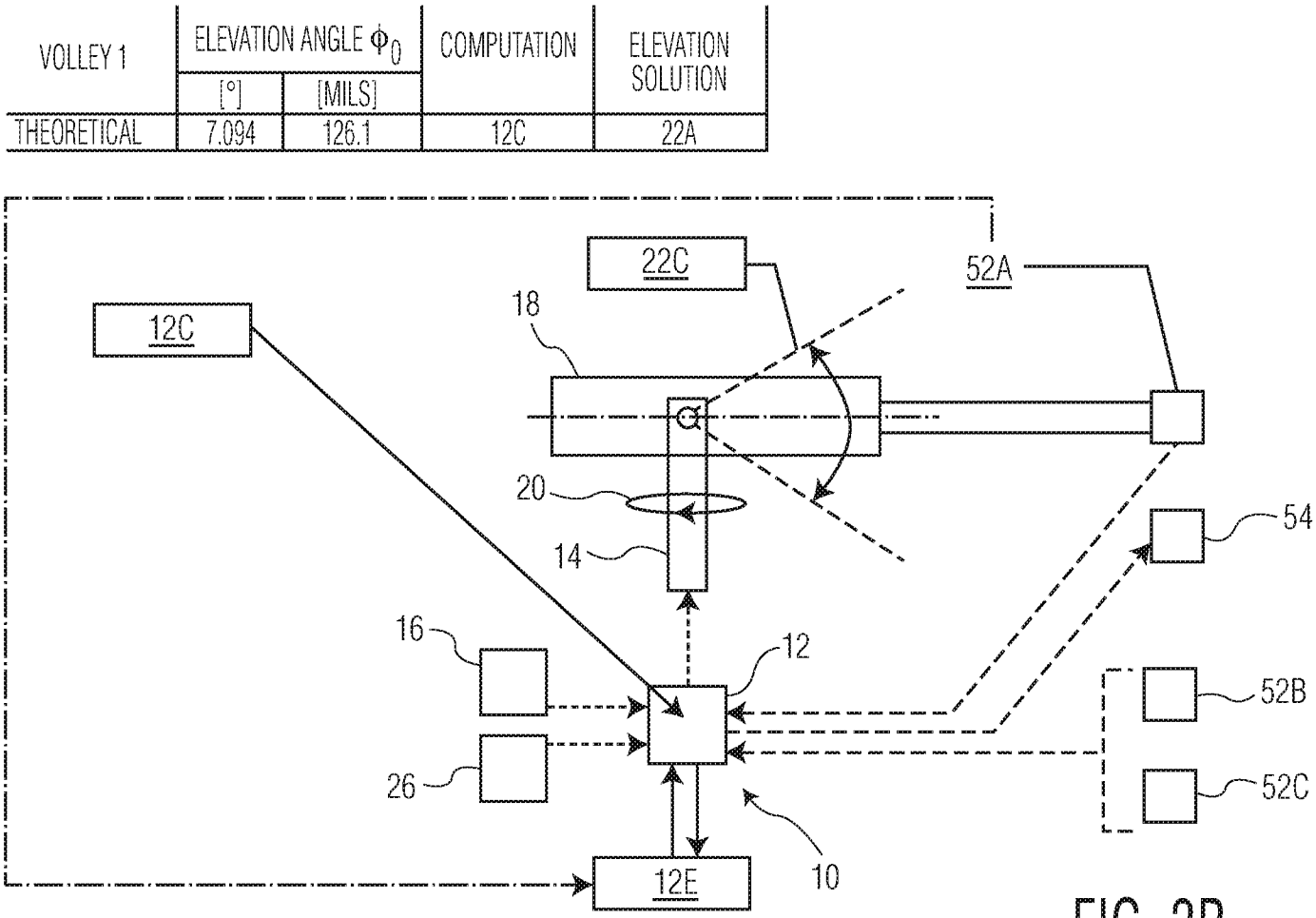
FIG. 3B is a system block diagram for a US M151 RWS, firing a second volley with an improved system function to measure muzzle velocity, adjusting elevation and firing a programmable air-burst projectile. The table in the top left corner of the figure depicts a method of computation used in the fire control ballistic computer and a resulting elevation solution.
Figure 3C:
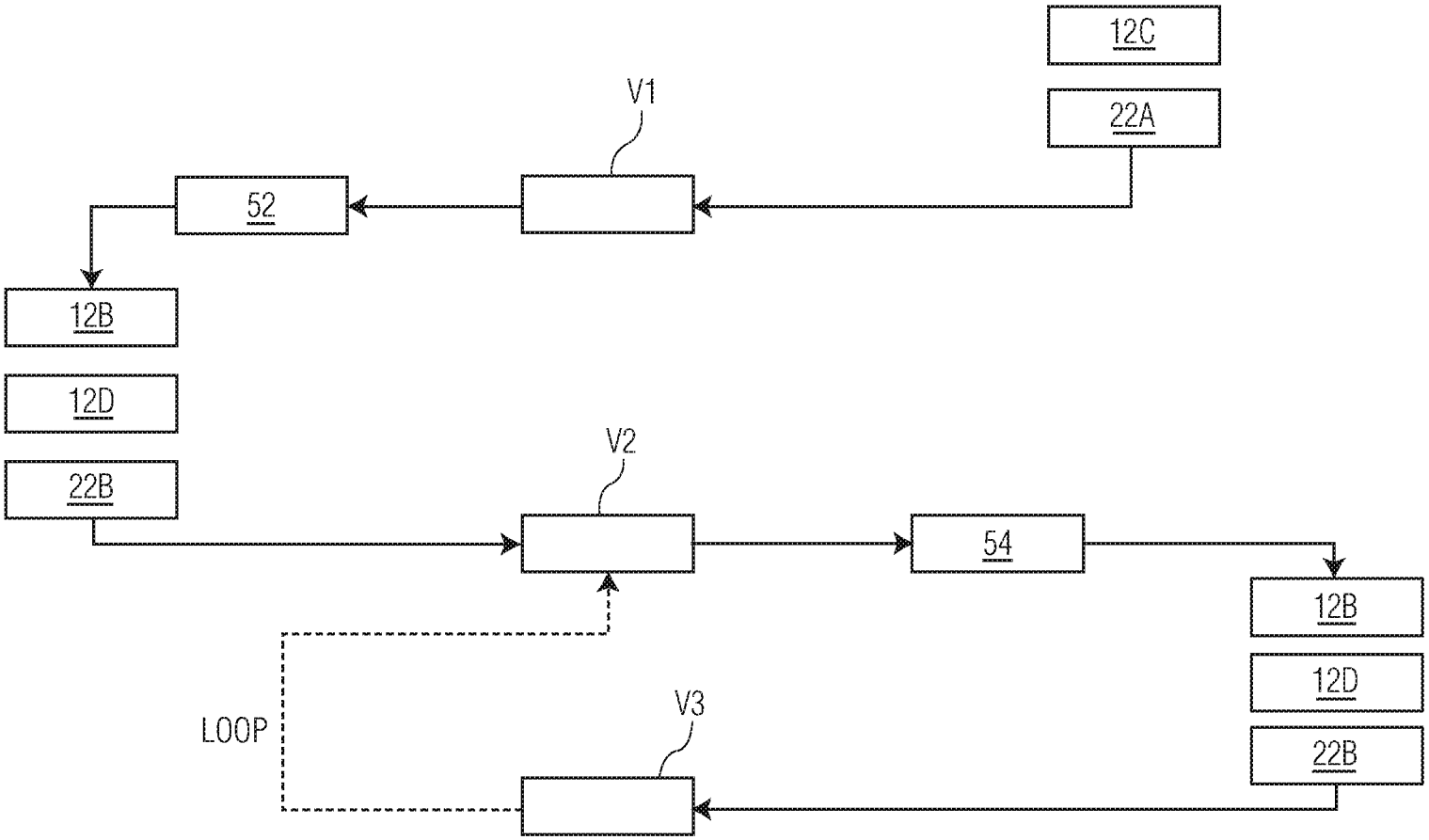
FIG. 3C is a system function sequence diagram for an exemplary initial commutation, based on an algorithm or table, identifying an elevation solution for a second volley with a re-adjusted elevation, where the weapon system previously measured the first volley muzzle velocity.

FIG. 3A depicts a remote weapon station system with a muzzle velocity measurement device 52A, 52B, 52C and programmer 54. With reference to FIG. 3B, the remote weapon station firing a first engagement volley aims the weapon using a theoretical or default muzzle velocity 12C and may adjust the users aiming point 12F. As represented in FIG. 3C, a second volley is aimed using a ballistic solution algorithm 12D that runs, based on the measured muzzle velocity. FIG. 3C depicts the sequence of fire control sub-routines of a first, second and subsequent volley.

FIG. 3A is an external view of improved remote weapon configuration according to the invention, with a muzzle velocity measurement device 52 mounted on a weapon's muzzle.

FIG. 3B shows a system diagram for US M151 RWS Remote Weapon Station that includes a conventional muzzle velocity measurement device 52A, or a radar device 52B that may include a position sensor 52C, such as that disclosed in U.S. Pat. No. 8,074,555. This RWS system operates with a projectile programmer 54.

The initial commutation in the system of FIG. 3B is based on an algorithm or table 12C, identifying an elevation solution 22C. The table (left top) identifies the theoretical elevation for a 40 mm AGL cartridge where the solution is derived from a firing table.

FIG. 3C is a process flow diagram illustrating the remote weapon station's control sequencing when firing volleys V, with control sub-routines identified. The exit velocity of the first volley V1 is measured at 52 and a fire control computer 12B then calculates a fire control solution 12C based on an algorithm that uses a default muzzle velocity. When firing a second volley V2, an alternative fire control algorithm 12D re-adjusts the elevation 22B.

Figure 3D:
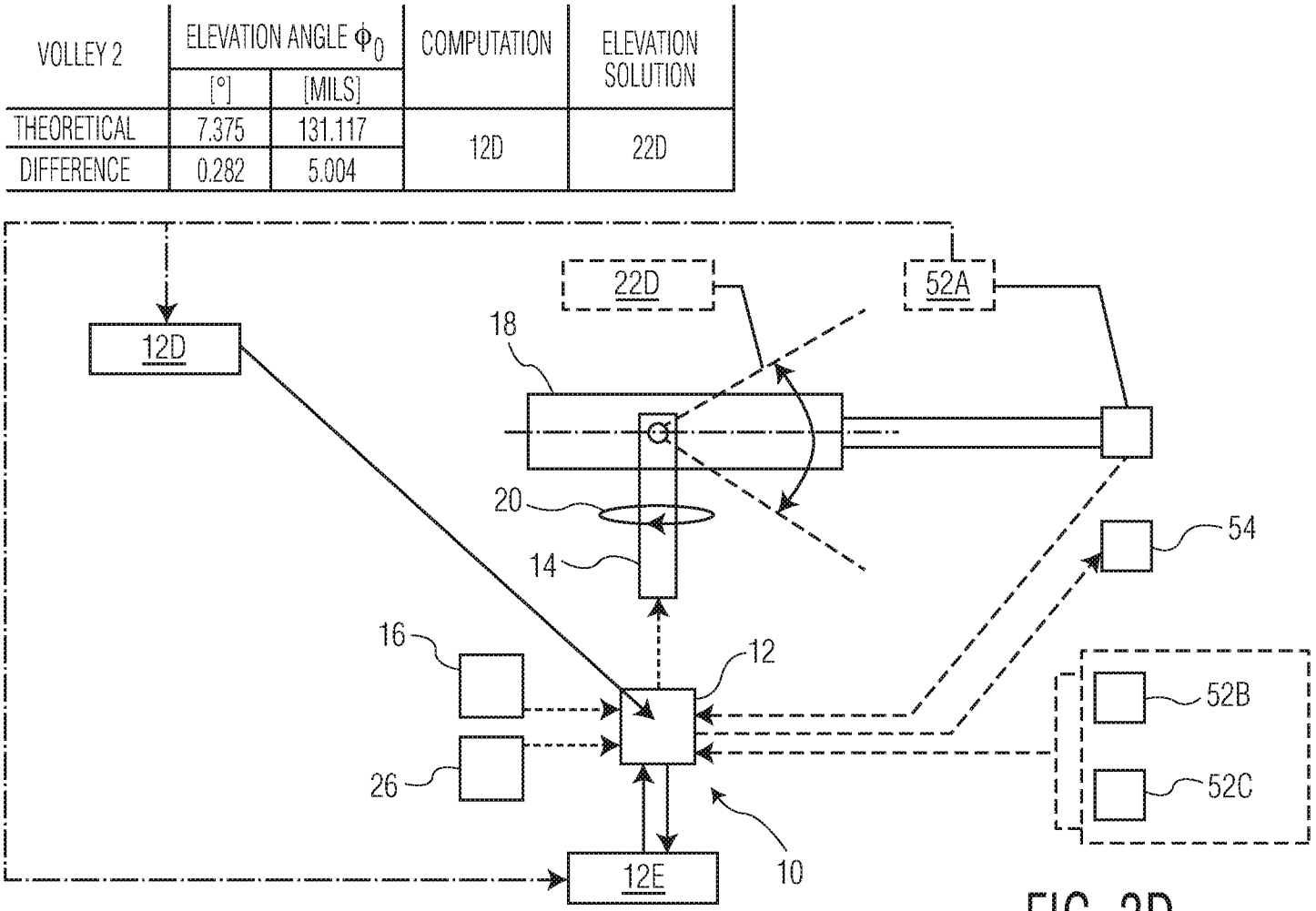
FIG. 3D is a system function sequence diagram for a second volley elevation solver using a histogram of prior shots data, producing a revised solution for a second and subsequent volleys. The diagram depicts sequencing of volleys and fire control sub-routines where a first volley calculates a solution based on a default muzzle velocity and second and subsequent volleys use actual measured muzzle velocity.

FIG. 3D shows a system in which the muzzle velocity of an initial volley is measured at 52A and a fire control computer 12, using measured velocity V1, re-adjusts the weapon and mechanical support 18 to a second elevation solution. This system relies on a histogram of prior shot muzzle velocity data stored in the fire control memory.

Figure 4A:
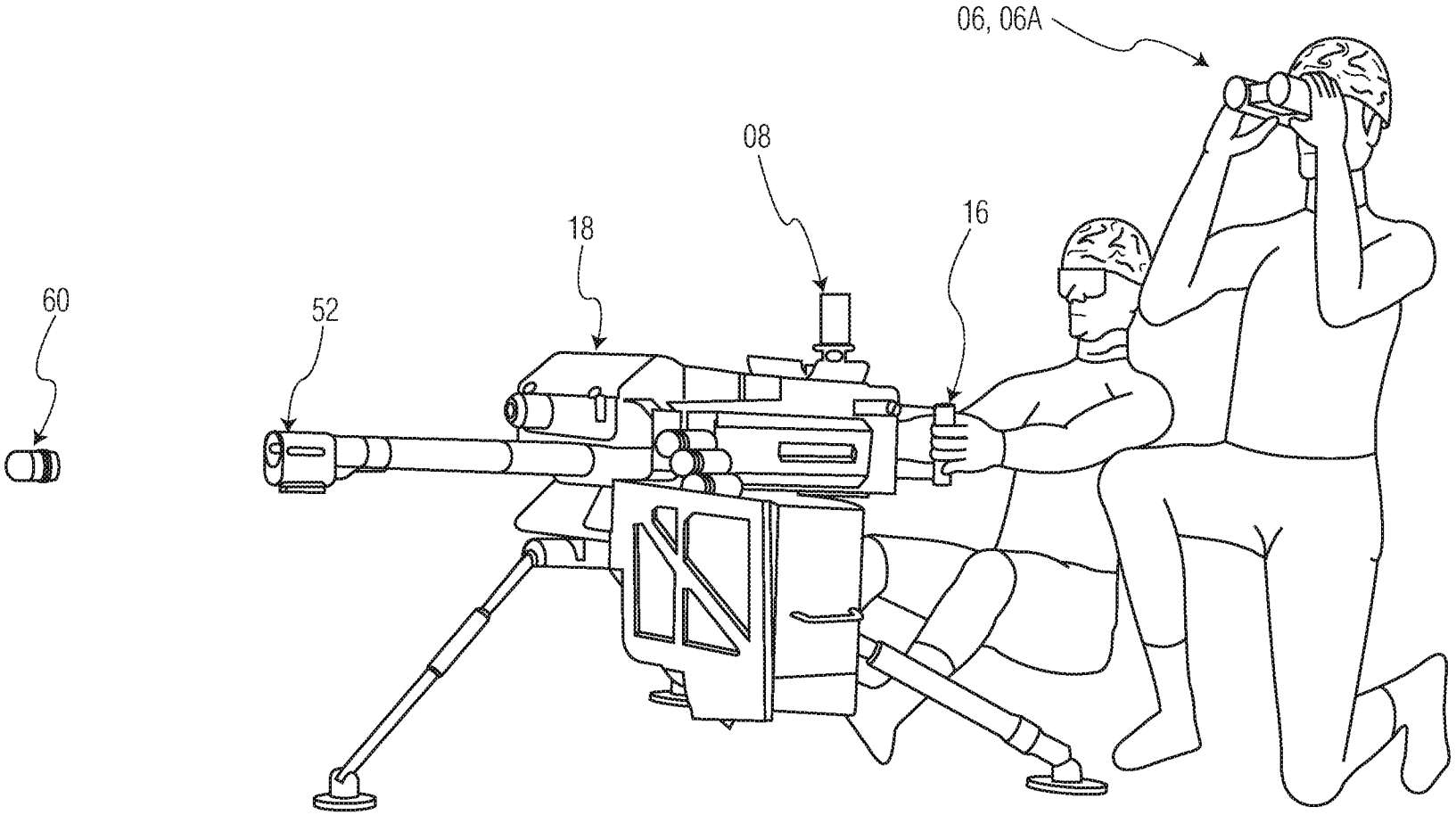
FIG. 4A depicts a manually-adjusted weapon, with a muzzle velocity sensor, a fire control and range finder incorporated into external binoculars.
Figure 4B:
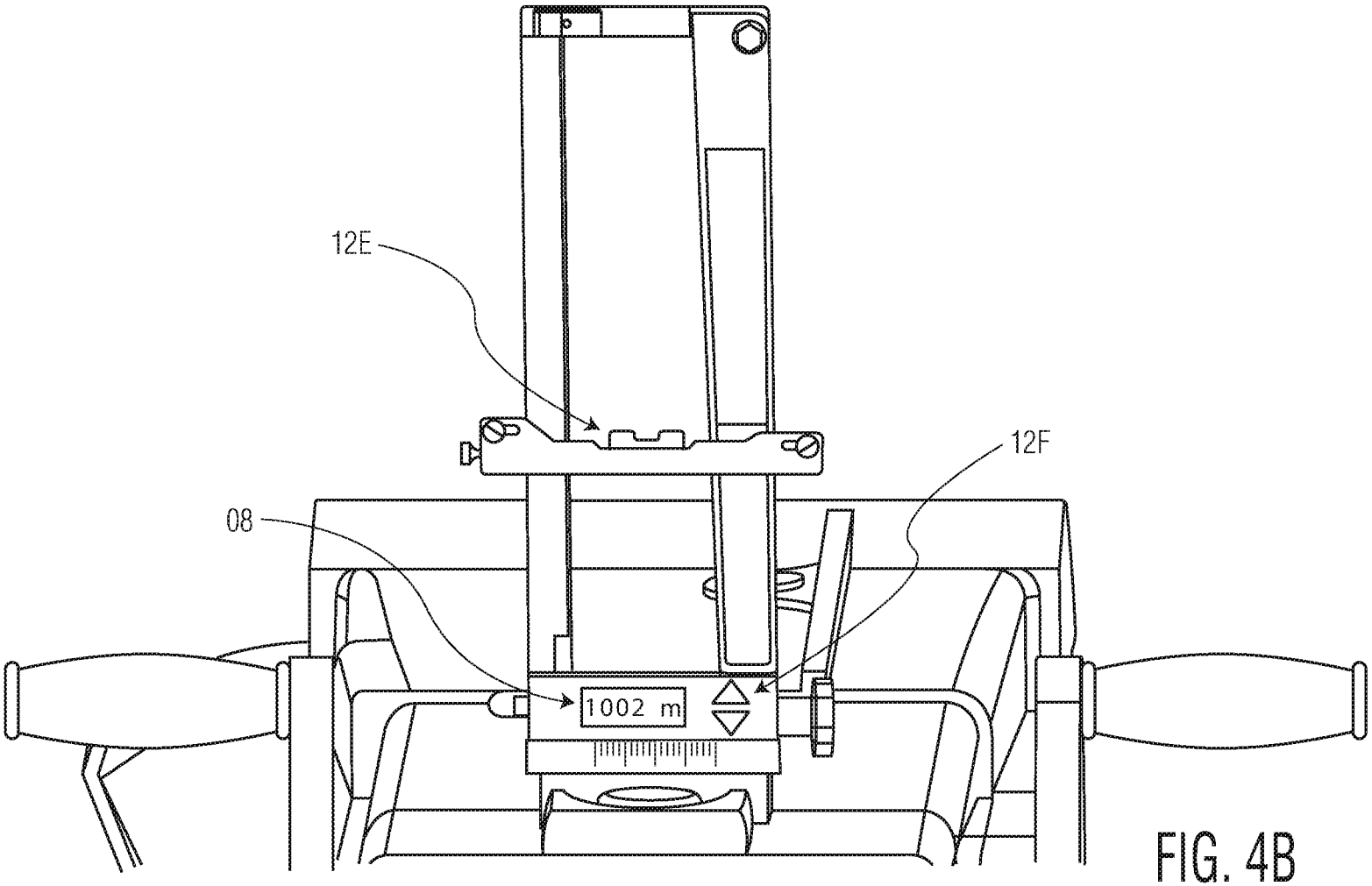
FIG. 4B depicts two views of an MK19 weapon from the gunner's perspective, showing a range output and an adjustment indicator.
Figure 4C:
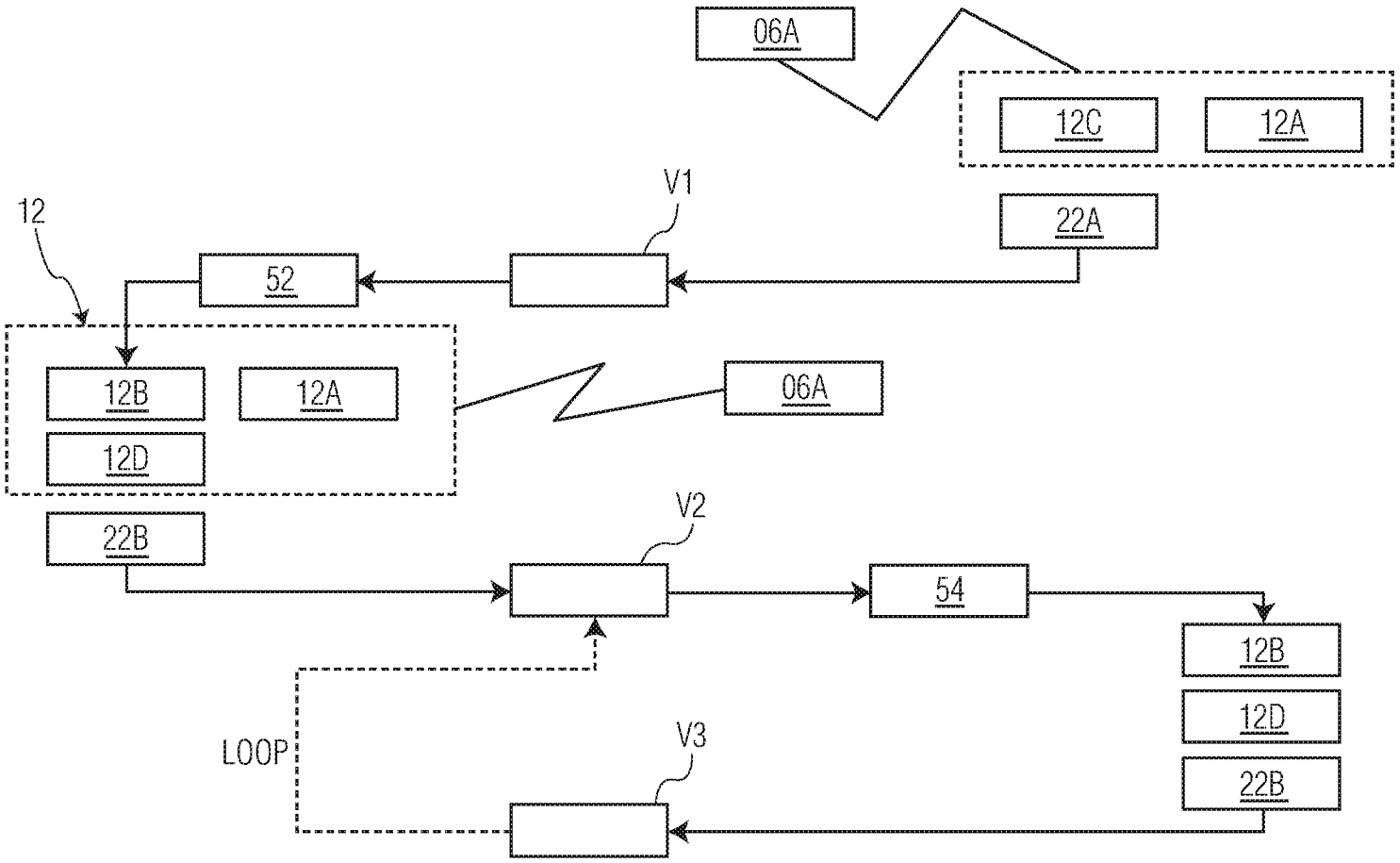
FIG. 4C is a system function sequence diagram showing an initial and subsequent elevation solutions.
Figure 4D:
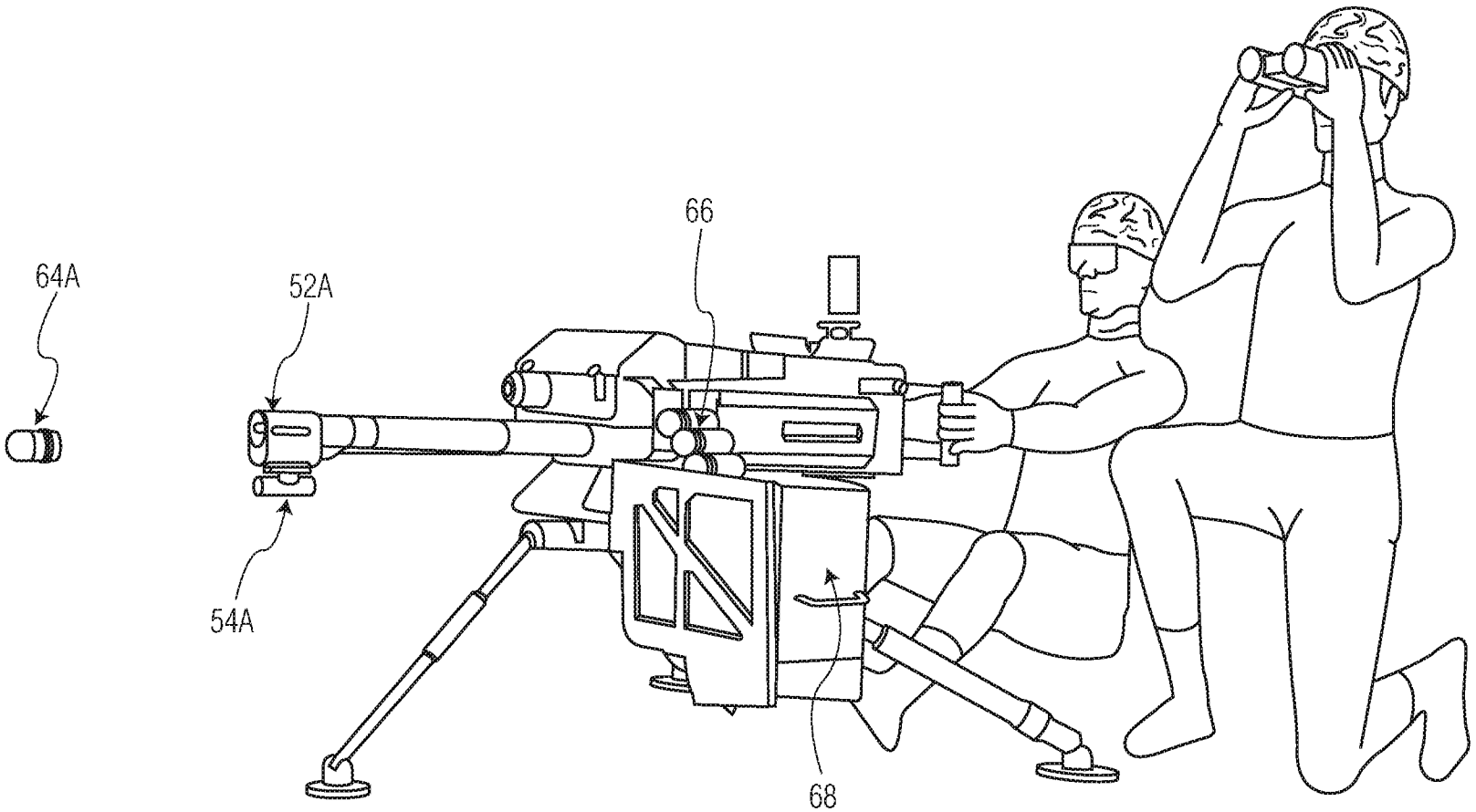
FIG. 4D depicts a manually-adjusted weapon, with a muzzle velocity sensor and a fire control device with a range finder incorporated into external binoculars. The weapon system is fitted with an optical programmer to set the detonation time of a programmable projectile.
Figure 4E:
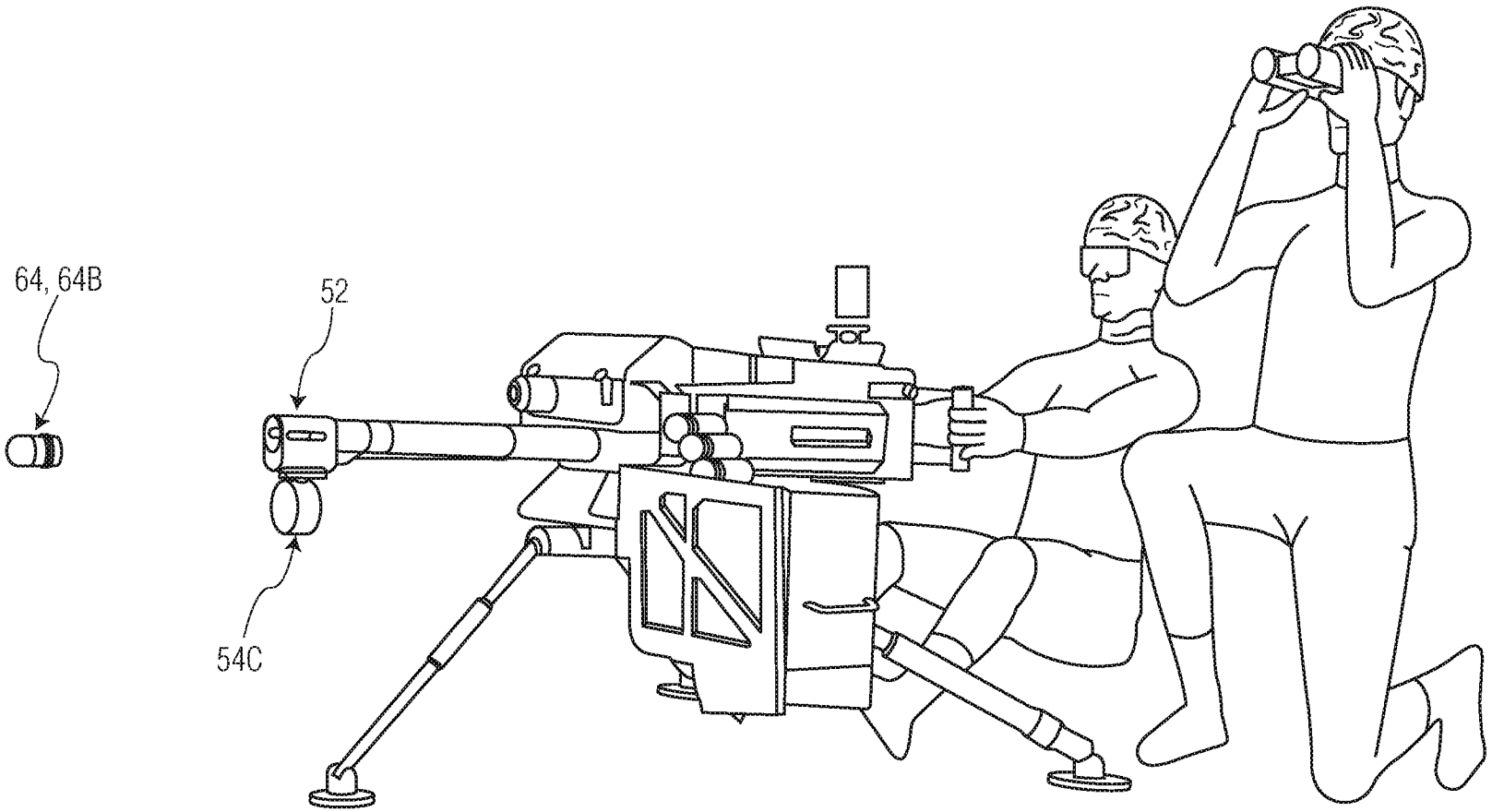
FIG. 4E depicts a manually-adjusted weapon, with a muzzle velocity sensor and a fire control device with range finder incorporated into external binoculars. The system is fitted with an RF or Extended Range Magnetic Induction programmer to set the detonation time of a programmable projectile.
Figure 4F:
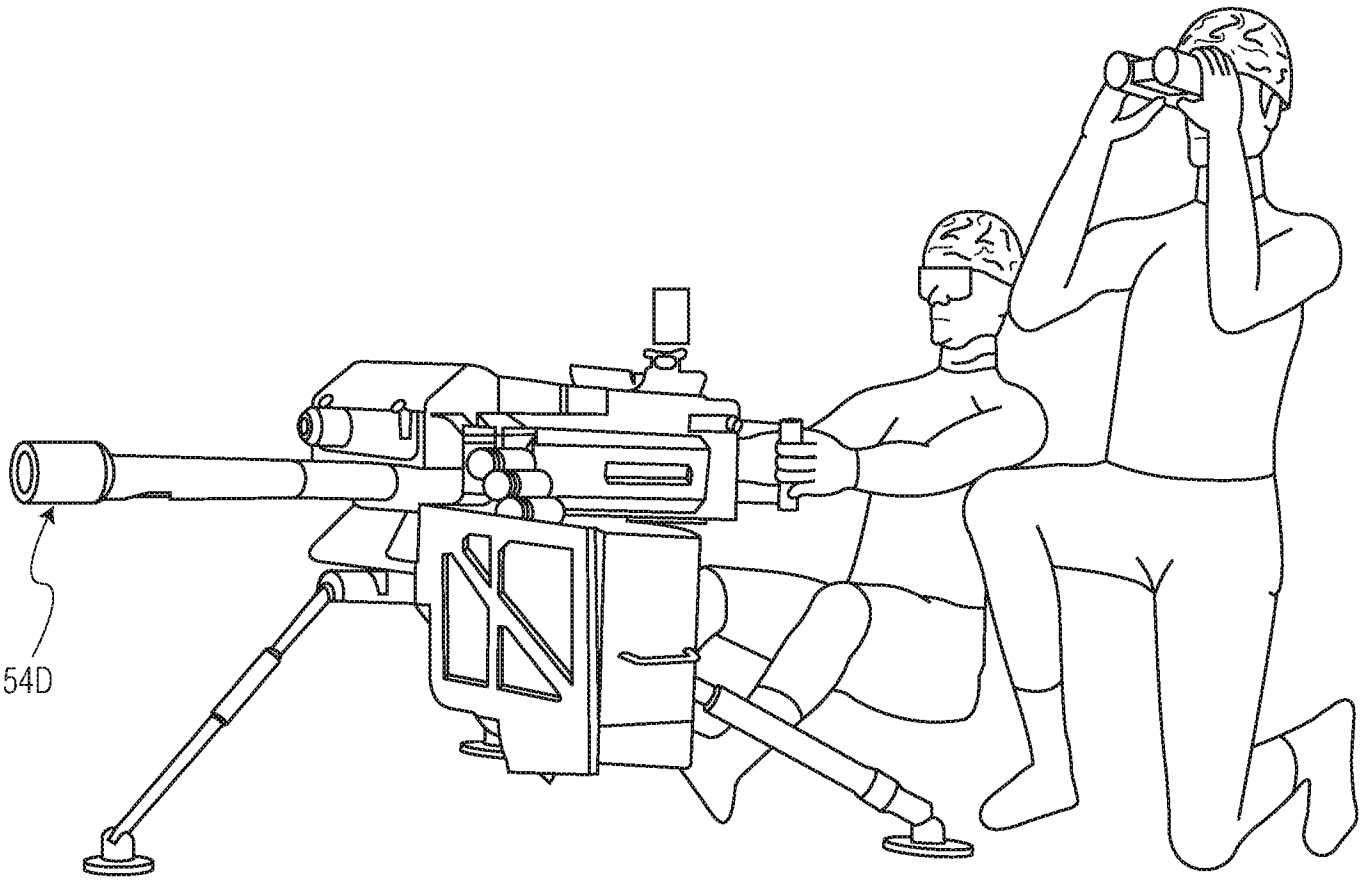
FIG. 4F depicts a manually-adjusted weapon, with a muzzle velocity sensor and a fire control device with range finder incorporated into external binoculars. The system is fitted with an Oerlikon AHEAD type of programmer to set the detonation time of a programmable projectile.
Figure 4F:
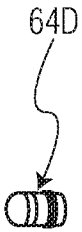

FIGS. 4A, 4B, 4C, 4D and 4E depict an alternative embodiment of the invention having a manually-elevated mounted weapon 18, with a display 08, connected to a fire control system 12D with a projectile velocity measurement sensor 52, where the system includes external range-finding binoculars with a data link 06A (either galvanic or wireless). This system may fire conventional cartridges 60 as depicted in FIG. 4A or programmable cartridges 64A, 64B and 64D as depicted in FIGS. 4D, 4E and 4F. FIG. 4F, similar to FIG. 2D, depicts the sequencing of firing the manually-elevated weapon with an in-bore muzzle velocity measurement and programmer 54D.

Range-finding binoculars with a data link output (for example, Bluetooth wireless or an RS232 cable connection) that are suitable for use with this system are available commercially. Examples are:

1. Zeiss Victory 10×45 T RF range-finding binoculars (with laser ballistic information system—BIS);
2. Nikon Laser force 10×42 mm range-finding binoculars (with a 905 nm laser range finder);
3. Leica Geovid 10×46/10×56 range-finder binoculars;
4. Steiner 8×30 military LRF binoculars (with laser range-finder and RS232 cable output for a galvanic interface connection); and 5. Newcon Optik LRB 4000 CI laser range-finder binoculars with an RS232 cable output interface.

The binoculars are used manually to determine range to the target and transmit the range to the fire control system 12D.

There has thus been shown and described a novel method and apparatus for improving the aim of a remote weapon station (RWS), when firing either a point-detonating or a programmable air-burst projectile, that fulfills all of the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

LIST OF REFERENCE NUMBERS

Ground Mount Configuration
06 Binoculars
06A Binoculars with a data link
08 Dismounted Aim Data Display
RWS Configuration
Remote Weapon Station
12 Fire Control Unit
12A Ballistic calculator in fire control
12B Memory (Histogram) in fire control
12C Algorithm or Table with assumed muzzle velocity
12D Algorithm using measured muzzle velocity
12E Preliminary Elevation Indicator
12F Adjusted Elevation Indicator
Common Sub-Systems
16 (Human) Input Means
18 Weapon Mounted on Mechanical Support
Spatial Position, Ballistics and Target Engagement
22 Elevation
22A Theoretical Elevation
22B Sensor Adjusted Elevation
26 Threat Detection System
Level Target
42 Elevated Target
44 Trajectory
44*a* Level Trajectory
44*b* Elevated Trajectory
44*c* Elevation Adjusted for Exit Velocity
44*mva* Trajectory with a muzzle velocity 1 sigma less than the mean
44*mv*0 Trajectory with a muzzle velocity equal to the mean
44*mvb* Trajectory with a muzzle velocity 1 sigma greater than the mean
44*mvi* Improved Aim and Trajectory of $2^{nd}$ volley
T1 Programmed Time 1 sans exit velocity measurement
T2 Programmed Time 1 adjusting for measured projectile exit velocity
P1 Probability of Missing a Target
P2 Probability of Hitting a Target
MV Mean Theoretical Muzzle Velocity Used by Fire Control
Improved System Sequence of Operation
V1 $1^{st}$ Volley using a theoretical muzzle velocity
V2 $2^{nd}$ Volley using sensor measured muzzle velocity from $1^{st}$ volley
V3 $3^{rd}$ Volley using sensor measured muzzle velocity from $2^{nd}$ volley
New Sensors and Emitters
52 Projectile Measurement Sensor
52A Muzzle Exit (Velocity)
52B Radar
52C Position Beacon
54 Programmer
54A Optical Programmer
54B RF or XMI Programmer
54C AHEAD Type Programmer
Projectile Programming Methodology
60 Projectile
62 Conventional Projectile
64 Programmable Air-Burst Projectile
64A Optically programmed air-burst projectile
64B RF or XMI programmed air-burst projectile
64C AHEAD type air-burst projectile
66 Unfired Ammunition Cartridge with a projectile
68 Ammunition Can or Package

What is claimed is:

1. A system located in the vicinity of a weapon having a barrel for firing a succession of projectiles that follow extenuated curved ballistic trajectories toward a distant target, said system being operative when each projectile is fired from the weapon to record its changing vertical and lateral positions over its ballistic path during its ballistic flight after barrel exit, said system comprising, in combination;

a radiation source at the location of the weapon for transmitting radiation toward the rear surface of the projectile during its ballistic flight, where said radiation source is a steerable laser beam with a control for causing the radiation emitted from the laser to intersect with the ballistic path of the projectile;

a radiation detector at the location of the weapon for detecting return radiation received from the rear surface of the projectile in response to said radiation emitted by said radiation source and capturing said changing vertical and lateral positions of the projectile during its ballistic flight, said detector producing measurable output signals representing said changing vertical and lateral positions of the projectile; and an output device, coupled to the radiation detector and receiving said output signals, for recording said changing vertical and lateral positions of the projectile as it exits the barrel transitioning to the apogee, and for calculating an adjustment in the aim of the weapon toward the target, prior to firing a subsequent projectile, the output device further comprising a sensor measuring drop and drift of the projectile, wherein the sensor tracks said extenuated ballistic curve, and wherein said projectile has an elongate circular body with side and rear surfaces and a photo-luminescent material, disposed on the rear surface that re-emits radiation at when excited by receipt of radiation from the radiation source.

2. The system defined in claim 1, wherein said output device comprises:

a) a signal processor, coupled to the radiation detector, for processing said electronic signals to determine the spatial (X and Y) coordinates of the projectile during flight; and b) a computer, coupled to the signal processor and to the output device, for calculating a lateral correction and a vertical correction in the aim of the weapon;

wherein said output device facilitates the lateral and vertical correction in the aim of the weapon.

3. The system defined in claim 2, wherein one of the signal processor and the computer calculates the lateral drift and the vertical drop of the projectile during its ballistic flight.

4. The system defined in claim 1, wherein the output device produces a lateral and vertical correction to the aim of the weapon.

5. The system defined in claim 1, wherein the output device allows for adjustment of the aim of the weapon by imparting, post firing, lateral and vertical corrections to the aim.

6. The system defined in claim 1, wherein the radiation emitted from the laser source is diffused and directed to optimize illumination of the projectile's flight path.

7. The system defined in claim 1, wherein the radiation detector is a digital video camera for capturing an image of the ballistic path of the projectile.

8. The system defined in claim 1, wherein the radiation detector includes a filter, allowing the radiation received from the projectile to be selectively received and other radiation excluded.

9. The system defined in claim 1, wherein the frequency of said radiation is in one of the UV, visual and IR spectral bands.

10. The system defined in claim 9, wherein said output device includes a aiming device allowing an operator to adjust the aim of the weapon.

11. The system defined in claim 1, wherein said output device includes a display showing said vertical and lateral positions of the projectile.

12. The system defined in claim 1, wherein the radiation source emits timed radiation signals at specific time intervals.

13. The system defined in claim 1, wherein said radiation source is a source of pulsed radiation directed toward the ballistic path of the projectile and emitted at predetermined times (T1, T2, T3 . . . Tn) following firing of the projectile (at time T0) and wherein said radiation detector receives radiation signals retro-reflected from the projectile at times (T1*z*, T2*z*, T3*z* . . . Tnz) and produces electronic signals representing the vertical and lateral positions of the projectile at said times (T1*z*, T2*z*, T3*z*, . . . Tnz), where "z" is a round trip transmission time of the radiation and T1*z*, T2*z*, T3*z* . . . Tn are the respective times T1, T2, T3, . . . Tip each delayed by amount z.

14. The system defined in claim 1, wherein said photoluminescent material is additionally disposed on a side surface of the projectile body.

15. The system defined in claim 1, wherein said photoluminescent material is a fluorescent dye.

16. A system located in the vicinity of a weapon having a barrel for firing a succession of projectiles that follow extenuated curved ballistic trajectories-toward a distant target, said system being operative when each projectile is fired from the weapon to record its changing vertical and lateral positions over its ballistic path during its ballistic flight after barrel exit, said system comprising, in combination;

a radiation source at the location of the weapon for transmitting radiation toward the rear surface of the projectile during its ballistic flight, where said radiation source is a steerable laser beam with a control for causing the radiation emitted from the laser to intersect with the ballistic path of the projectile;

a radiation detector at the location of the weapon for detecting return radiation received from the rear surface of the projectile in response to said radiation emitted by said radiation source and capturing said changing vertical and lateral positions of the projectile during its ballistic flight, said detector producing measurable output signals representing said changing vertical and lateral positions of the projectile; and an output device, coupled to the radiation detector and receiving said output signals, for recording said changing vertical and lateral positions of the projectile as it exits the barrel transitioning to the apogee, and for calculating an adjustment in the aim of the weapon toward the target, prior to firing a subsequent projectile, the output device further comprising a sensor measuring drop and drift of the projectile, wherein the sensor tracks said extenuated ballistic curve, and wherein said projectile has an elongate circular body with side and rear surfaces a retro-reflective element, disposed on the rear surface, that reflects radiation received from a radiation source in the direction of the radiation source.

17. The system defined in claim 16, wherein said retro-reflective element is additionally disposed on a side surface of the projectile body.

18. The ammunition projectile defined in claim 16, wherein said retro-reflective element is affixed to the projectile body.

19. The ammunition projectile defined in claim 16, wherein said retro-reflective element is coated on the projectile body.

20. The system defined in claim 16, wherein said retro-reflective element is positioned and oriented on the projectile body to allow for the rearward travel of reflected light, notwithstanding a yawing motion of the projectile during flight.

21. The system defined in claim 16, wherein said retro-reflective element is selected from the group consisting of corner cube reflectors, cat eyes and phase conjugated mirrors.

22. A system for correcting the aim of a weapon which is operative to launch a projectile from a barrel on a ballistic path toward a target, the projectile having an elongate housing with a rear end and fluorescent dye material disposed on the rear end that produces radiation at a first frequency when excited by receipt of radiation at a second frequency, said aim correcting system comprising, in combination;

(1) a radiation source of pulsed light at said first frequency directed toward the ballistic path of the projectile and emitted at predetermined times (T1, T2, T3 . . . ) following firing of the projectile (at time T0);

(2) a radiation detector at the location of the weapon for receiving light radiation signals re-emitted by the fluorescent dye on the projectile at times (T1*z*, T2*z*, T3*z* . . . Tnz) and producing electronic signals representing the vertical and lateral positions of the projectile at said times (T1*z*, T2*z*, T3*z*, . . . Tnz), where "z" is a re-emission delay and T1*z*, T2*z*, T3*z* . . . are the respective times T1, T2, T3, . . . Tn each delayed by amount z;

(3) a signal processor, coupled to the radiation detector, for processing said electronic signals to determine the spatial (X and Y) coordinates of the projectile at said times (I' T2*z*, T3*z*, . . . Tn) during flight;

(4) a computer, coupled to the processor, for calculating a lateral correction and a vertical correction in the aim of the weapon; and (5) an output device, coupled to the computer, for facilitating an adjustment in the aim of the weapon toward the target, prior to firing the next projectile;

wherein said aim of the weapon may be adjusted after launch of the projectile to compensate for errors prior to launch of another projectile.

23. The system defined in claim 22, wherein one of the signal processor and the computer calculates the lateral drift and the vertical drop of the projectile at said predetermined times.

24. The system defined in claim 22, wherein said radiation source is laser source, configured to be affixed to the weapon so that a cone of illumination of the laser source intersects with the ballistic path of the projectile and excites the fluorescent dye material.

25. The system defined in claim 24, wherein said laser source transmits light through a narrow band-pass filter so that the cone of illumination in a narrow frequency range intersects the ballistic path of the projectile and excites the fluorescent dye material.

26. The system defined in claim 25, wherein said fluorescent dye on the rear surface of the projectile responds preferentially to the laser light illumination in the narrow frequency range.

27. The system defined in claim 22, wherein the radiation detector is a digital camera for producing an image of the ballistic path of the projectile.

28. The system defined in claim 22, wherein the radiation detector includes a narrow band-pass filter, allowing re-emitted light from the fluorescent dye material to be selectively received and other light excluded.

29. The system defined in claim 22, wherein said fluorescent dye on the rear of the projectile has a protective transparent coating.

30. The system defined in claim 22, wherein said first frequency is in one of the UV, visual and IR spectral bands.

31. The system defined in claim 22, wherein said output device is a display.

32. The system defined in claim 31, wherein said output device includes a aiming device allowing an operator to adjust the aim of the weapon.

33. The system defined in claim 22, wherein the output device allows for adjustment of the aim of the weapon by imparting, post firing, lateral and vertical corrections.

34. The system defined in claim 22, wherein the signal processor determines the time duration of the radiation signals received at said second frequency in response to radiation pulses emitted at said first frequency, and wherein said computer distinguishes the signals received from each projectile from among signals received from other, successively fired projectiles in dependence upon said time duration.

35. The system defined in claim 34, further comprising an electronic control circuit with a clock that modulates the radiation source to emit radiation with specific time durations at specific times, thereby producing a strobe effect, illuminating the projectile's ballistic path along the projectile's ballistic flight to the target.

* * * * *